US010618296B2

(12) United States Patent
Takeda et al.

(10) Patent No.: US 10,618,296 B2
(45) Date of Patent: Apr. 14, 2020

(54) LIQUID EJECTING APPARATUS

(71) Applicant: SEIKO EPSON CORPORATION, Tokyo (JP)

(72) Inventors: Kazuhisa Takeda, Shiojiri (JP); Kazuo Otsuka, Azumino (JP); Satoshi Kawamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/203,494

(22) Filed: Nov. 28, 2018

(65) Prior Publication Data

US 2019/0160825 A1 May 30, 2019

(30) Foreign Application Priority Data

Nov. 29, 2017 (JP) ..... 2017-229211

(51) Int. Cl.

| | |
|---|---|
| ***B41J 2/175*** | (2006.01) |
| ***B41J 13/02*** | (2006.01) |
| ***B41J 13/10*** | (2006.01) |
| ***B41J 29/02*** | (2006.01) |
| ***B41J 29/38*** | (2006.01) |
| ***B41J 29/13*** | (2006.01) |
| ***B41J 19/00*** | (2006.01) |

(52) U.S. Cl.

CPC ..... *B41J 2/17523* (2013.01); *B41J 2/1752* (2013.01); *B41J 2/17509* (2013.01); *B41J 2/17553* (2013.01); *B41J 13/02* (2013.01); *B41J 13/106* (2013.01); *B41J 19/005* (2013.01); *B41J 29/02* (2013.01); *B41J 29/13* (2013.01); *B41J 29/38* (2013.01)

(58) Field of Classification Search

CPC .. B41J 2/17509; B41J 2/1752; B41J 2/17523; B41J 2/17553; B41J 13/02; B41J 13/106; B41J 19/005; B41J 29/02; B41J 29/13; B41J 29/38

See application file for complete search history.

(56) References Cited

U.S. PATENT DOCUMENTS 6,174,055 B1 * 1/2001 Sugikubo ..... B41J 3/4078 347/18
9,387,497 B2 * 7/2016 Yoshida ..... B05B 3/18
(Continued)

FOREIGN PATENT DOCUMENTS

JP 2015-098092 A 5/2015
JP 6021294 B 10/2016

*Primary Examiner* — Anh T Vo
(74) *Attorney, Agent, or Firm* — Workman Nydegger

(57) ABSTRACT

A liquid ejecting apparatus includes a carriage unit which is provided with a liquid ejecting head, a liquid storage container which is storing a liquid, a tube which is connected to the carriage unit and which supplies the liquid which is fed from the liquid storage container to the carriage unit, a first driven roller which is provided on a downstream of the liquid ejecting head and which comes into contact with a surface of the medium which faces the liquid ejecting head, and a tube support surface which is positioned closer to a bottom side than the carriage unit in a vertical direction, and supports the tube, in which the tube support surface is at a position which is deviated from the first driven roller in the transport direction of the medium and falls within a height range of the first driven roller in the vertical direction.

11 Claims, 17 Drawing Sheets

(56) References Cited

U.S. PATENT DOCUMENTS

| | | | | |
|---|---|---|---|---|
| 2006/0256169 | A1* | 11/2006 | Kobayashi | B41J 2/17509 347/85 |
| 2012/0062648 | A1* | 3/2012 | Tanaka | B41J 19/00 347/37 |
| 2015/0174907 | A1* | 6/2015 | Kimura | B41J 2/175 347/85 |

* cited by examiner

LIQUID EJECTING APPARATUS

BACKGROUND

1. Technical Field

The present invention relates to a liquid ejecting apparatus which ejects a liquid onto a medium to perform recording.

2. Related Art

An ink jet printer is an example of a liquid ejecting apparatus which ejects a liquid. A so-called serial type ink jet printer which is provided with a recording head as a liquid ejecting unit which ejects an ink which is an example of a liquid, and which is provided with a carriage which is moving in a predetermined direction is an example of an ink jet printer.

Other examples of an ink jet printer include an ink jet printer in which an ink storage container which stores the ink is mounted on a carriage and an ink jet printer in which the ink storage container is provided at a separate location outside of the carriage. In the ink jet printer in which the ink storage container is provided outside of the carriage, the ink storage container and the carriage (a recording head) are connected to each other by an ink supply tube (hereinafter referred to as an "ink tube").

The ink tube extends from the ink storage container, is subsequently folded to form a curved portion, and is routed to head toward the carriage. The ink tube deforms following the movement actions of the carriage.

Japanese Patent No. 6021294 discloses an ink jet recording apparatus in which a tube guide which is provided to extend in a movement direction of a carriage receives a tube from the bottom side of the tube. In the ink jet recording apparatus, the tube guide is installed above a paper discharge frame. The paper discharge frame is a frame which supports a paper discharge driven roller which is positioned on the downstream of an ink jet head.

It is preferable that a curvature radius of a curved portion which is formed by a tube be as large as possible. This is because, when the curvature radius of the curved portion which is formed by the tube is small, a restorative force of the tube increases in magnitude and adversely influences movement actions of a carriage.

However, in the configuration described in Japanese Patent No. 6021294, when the curvature radius of the curved portion which is formed in the tube is simply increased, the increase leads to an increase in a height direction dimension of the apparatus, that is, leads to an increase in the size of the apparatus. There is room for further improvement of this point in a liquid ejecting apparatus of the related art.

SUMMARY

An advantage of some aspects of the invention is to secure a curvature radius of a curved portion which is formed in a tube while suppressing an increase in the size of an apparatus.

According to an aspect of the invention, there is provided a liquid ejecting apparatus including a carriage unit which is provided with a liquid ejecting head which ejects a liquid onto a medium, and which moves reciprocally in a scanning direction, a liquid storage container which is storing the liquid to be ejected from the liquid ejecting head, a tube which is connected to the carriage unit and which supplies the liquid which is fed from the liquid storage container to the carriage unit, a first driven roller which is provided on a downstream of the liquid ejecting head in a transport path of the medium and which comes into contact with a surface of the medium which faces the liquid ejecting head, and a tube support surface which is positioned closer to a bottom side than the carriage unit in a vertical direction, is provided to extend along the scanning direction of the carriage unit, and supports the tube, in which, setting one direction in the scanning directions of the carriage unit to a first direction and the other direction to a second direction, the tube extends along the tube support surface toward the second direction, forms a curved portion which curves vertically upward, turns in the first direction and is connected to the carriage unit, and in which the tube support surface is at a position which is deviated from the first driven roller in the transport direction of the medium and falls within a height range of the first driven roller in the vertical direction.

In this configuration, the tube support surface which supports the tube is positioned to be deviated from the first driven roller in the transport direction of the medium, and falls within the height range of the first driven roller in the vertical direction, and so, it is possible to dispose the tube which is supported by the tube support surface at a low position. As a result, it is possible to secure the curvature radius of the curved portion which is formed in the tube, and so it is possible to suppress an increase in the size (the height direction dimension) of the apparatus.

The liquid ejecting apparatus may further include a roller support frame which supports the first driven roller, in which the tube support surface may be formed by the roller support frame.

In this configuration, since the liquid ejecting apparatus further includes the roller support frame which supports the first driven roller and the tube support surface is formed by the roller support frame, it is not necessary to provide a dedicated part for forming the tube support surface and it is possible to obtain cost reductions.

The liquid ejecting apparatus may further include a roller support frame which supports the first driven roller, in which the tube support surface may be formed by a sheet material which is provided on the roller support frame.

In this configuration, since the liquid ejecting apparatus further includes the roller support frame which supports the first driven roller and the tube support surface is formed by a sheet material which is provided on the roller support frame, that is, a configuration is adopted in which the tube is indirectly supported by the roller support frame, it is not necessary to provide a dedicated part for supporting the tube and it is possible to obtain cost reductions. It is possible to suppress the wear of the tube using the sheet material. Therefore, it is preferable that the sheet material be formed by a material having a lower rigidity than the roller support frame.

The liquid ejecting apparatus may further include a second driven roller which contacts a surface of the medium which faces the liquid ejecting head on a downstream of the first driven roller in the transport path of the medium, in which the tube support surface is positioned between the first driven roller and the second driven roller in the transport direction of the medium.

In this configuration, the operations and effects of the above-described configurations may be obtained in a configuration in which the liquid ejecting apparatus further includes a second driven roller which contacts a surface of the medium which faces the liquid ejecting head on a downstream of the first driven roller in the transport path of the medium, and the tube support surface is positioned between the first driven roller and the second driven roller in the transport direction of the medium.

In the liquid ejecting apparatus, the tube support surface may fall within a height range of the second driven roller in the vertical direction.

In this configuration, since the tube support surface falls within the height range of the second driven roller in the vertical direction, it is possible to secure similar operations and effects to those of the first configuration described above, that is, to secure the curvature radius of the curved portion which is formed in the tube more so than in the related art, and so it is possible to suppress an increase in the size of the apparatus.

In the liquid ejecting apparatus, bottom surface of the roller support frame may form the transport path of the medium.

In this configuration, the operations and effects of the second or the third configurations described above may be obtained in a configuration in which a bottom surface of the roller support frame forms the transport path of the medium.

The liquid ejecting apparatus may further include a curved inversion path which is provided closer to the downstream than the first driven roller in the transport path of the medium and which causes the medium to curve so as to be inverted with a surface of the medium on which recording is recently performed facing an inside, and a discharge roller which discharges the medium which is curved and inverted by the curved inversion path.

In this configuration, it is possible to obtain the operations and effects of any of the above-described configurations in a configuration in which the liquid ejecting apparatus further includes a curved inversion path which is provided closer to the downstream than the first driven roller in the transport path of the medium and causes the medium to curve so as to be inverted with a surface of the medium on which recording is recently performed facing an inside, and a discharge roller which discharges the medium which is curved and inverted by the curved inversion path.

In the liquid ejecting apparatus, the curved portion which is formed in the tube may fall within a height range of the curved inversion path in the vertical direction.

In this configuration, since the curved portion which is formed in the tube falls within a height range of the curved inversion path in the vertical direction, it is possible to suppress the height direction dimension of the apparatus.

The liquid ejecting apparatus may further include a medium receiving tray which is inclined to face upward along an discharge direction of the medium by the discharge roller and receives the medium which is discharged by the discharge roller, in which the medium receiving tray may be configured to include a first tray which is positioned on an upstream in the discharge direction and is provided in a fixed manner, and a second tray which is positioned on the downstream of the first tray in the discharge direction, is provided to be opening and closing, and exposes a movement region of the carriage unit by opening the second tray, and may be a section of the tube which turns in the first direction from the curved portion and is connected to the carriage unit may be disposed in an end portion region on a downstream in the discharge direction on a reverse side of the first tray.

In this configuration, since the section of the tube which turns in the first direction from the curved portion and is connected to the carriage unit is disposed in an end portion region on a downstream in the discharge direction on a reverse side of the first tray, the tube assumes a state of being concealed on the reverse side of the first tray when the second tray is opened, it is possible to avoid unintentional access to the tube, and it is possible to suitably maintain the ink flow path.

Since the section of the tube which turns in the first direction from the curved portion and is connected to the carriage unit is disposed in an end portion region on a downstream in the discharge direction on the reverse side of the first tray, by disposing the tube in a space in which it is possible to secure the greatest height direction dimension on the reverse side of the first tray, it is possible to secure the curvature radius of the curved portion which is formed in the tube, and so, it is possible to suppress an increase in the size (the height direction dimension) of the apparatus.

According to another aspect of the invention, there is provided a liquid ejecting apparatus including a carriage unit which is provided with a liquid ejecting head which ejects a liquid onto a medium, and which moves reciprocally in a scanning direction, a liquid storage container which is storing the liquid to be ejected from the liquid ejecting head, a tube which is connected to the carriage unit and which supplies the liquid which is fed from the liquid storage container to the carriage unit, a tube support surface which is positioned closer to a bottom side than the carriage unit in a vertical direction, is provided to extend along the scanning direction of the carriage unit, and supports the tube, a curved inversion path which is provided closer to a downstream than the liquid ejecting head in the transport path of the medium and causes the medium to curve so as to be inverted with a surface of the medium on which recording is recently performed facing an inside, a discharge roller which discharges the medium which is curved and inverted by the curved inversion path, and a medium receiving tray which is inclined to face upward along an discharge direction of the medium by the discharge roller and receives the medium which is discharged by the discharge roller, in which, setting one direction in the scanning directions of the carriage unit to a first direction and the other direction to a second direction, the tube extends along the tube support surface toward the second direction, forms a curved portion which curves vertically upward, turns in the first direction and is connected to the carriage unit, in which the medium receiving tray is configured to include the first tray which is positioned closer to the upstream in the discharge direction and is provided in a fixed manner, and in which a section of the tube which turns in the first direction from the curved portion and is connected to the carriage unit is disposed in an end portion region on a downstream in the discharge direction on a reverse side of the first tray.

In this configuration, since the section of the tube which turns in the first direction from the curved portion and is connected to the carriage unit is disposed in an end portion region on a downstream in the discharge direction on the reverse side of the first tray, by disposing the tube in a space in which it is possible to secure the greatest height direction dimension on the reverse side of the first tray, it is possible to secure the curvature radius of the curved portion which is formed in the tube, and so, it is possible to suppress an increase in the size (the height direction dimension) of the apparatus.

In the liquid ejecting apparatus, the medium receiving tray may be configured to include a second tray which is positioned on the downstream of the first tray in the discharge direction, is provided to be opening and closing, and exposes a movement region of the carriage unit by opening the second tray.

In this configuration, since the medium receiving tray is configured to include the second tray which is positioned on the downstream of the first tray in the discharge direction, is provided to be opening and closing, and exposes the movement region of the carriage unit by opening the second tray, it is possible to access the movement region of the carriage unit by opening the second tray, and it is possible to perform paper jam processing and the like, for example. Here, since the section of the tube which turns in the first direction from the curved portion and is connected to the carriage unit is disposed in an end portion region on a downstream in the discharge direction on a reverse side of the first tray, the tube assumes a state of being concealed on the reverse side of the first tray when the second tray is opened, it is possible to avoid unintentional access to the tube, and it is possible to suitably maintain the ink flow path.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
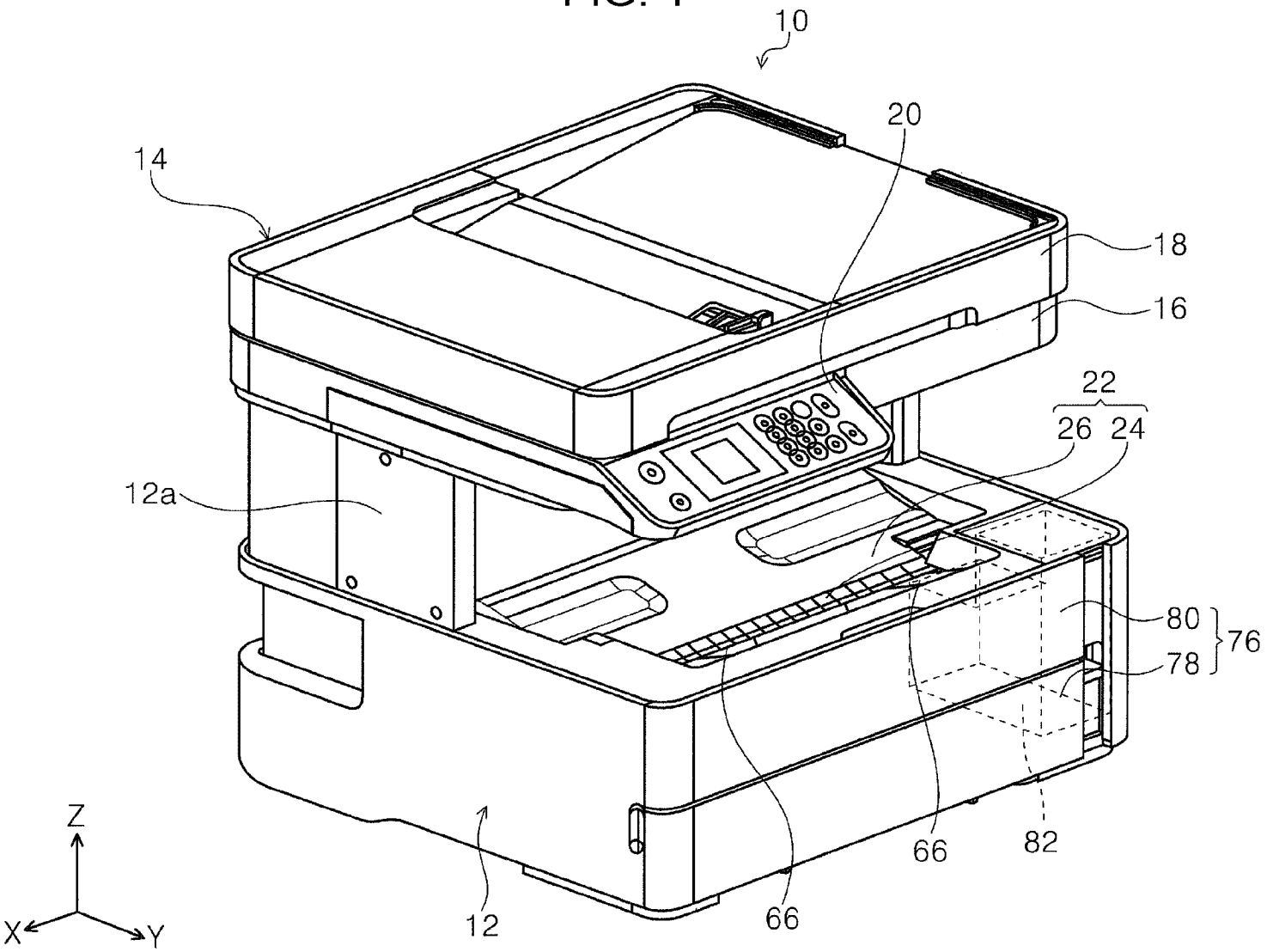
FIG. 1 is a perspective view of a printer according to an embodiment.

Hereinafter, description will be given of an embodiment of the invention with reference to the drawings. Regarding configurations which are the same in the embodiments, the same reference numerals will be given, a description will be given only in the first embodiment, and the description of the configurations will be omitted in the following embodiments.

Figure 2:
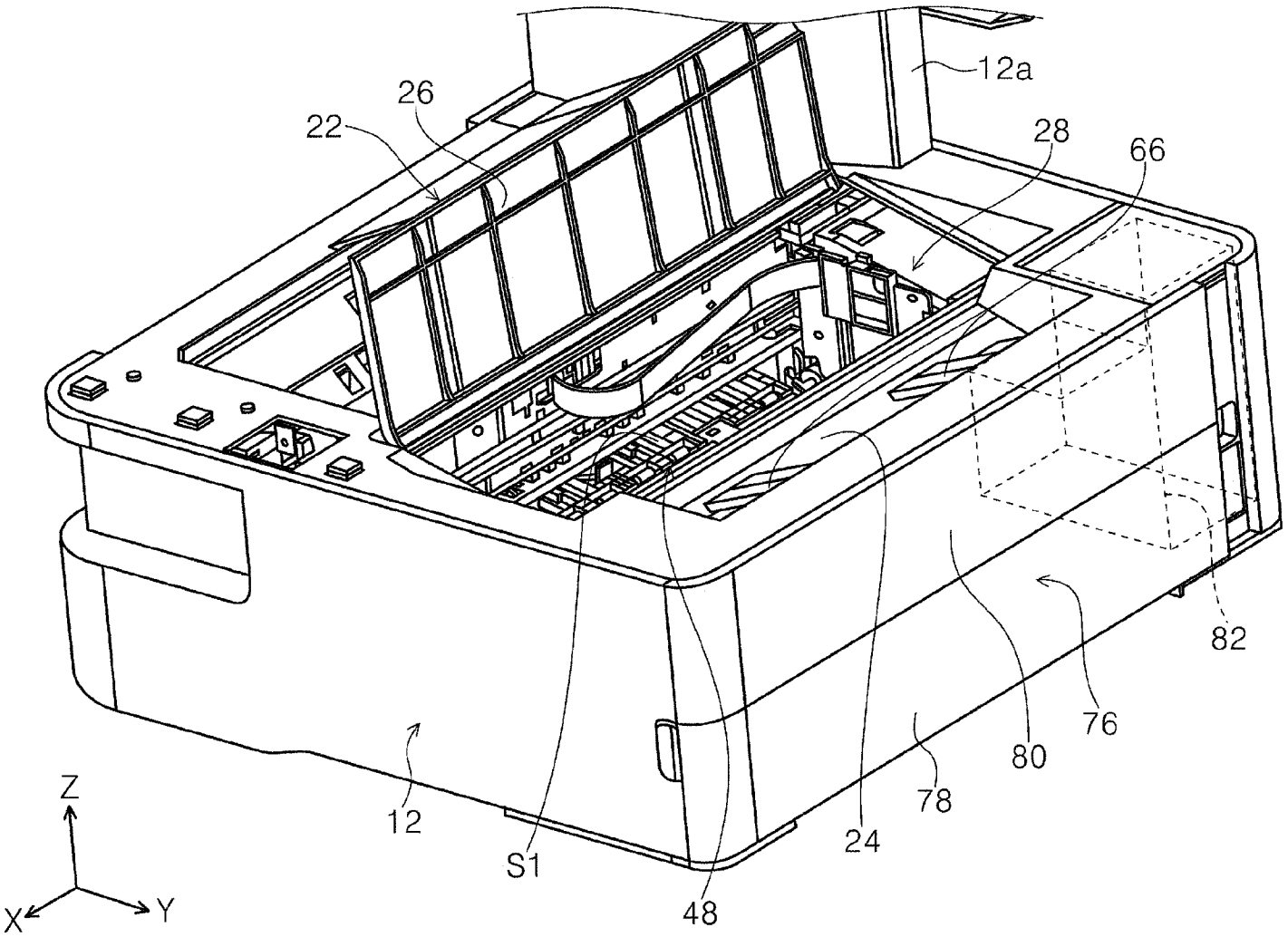
FIG. 2 is a perspective view illustrating a state in which a second tray is open in the printer according to the embodiment.
Figure 3:
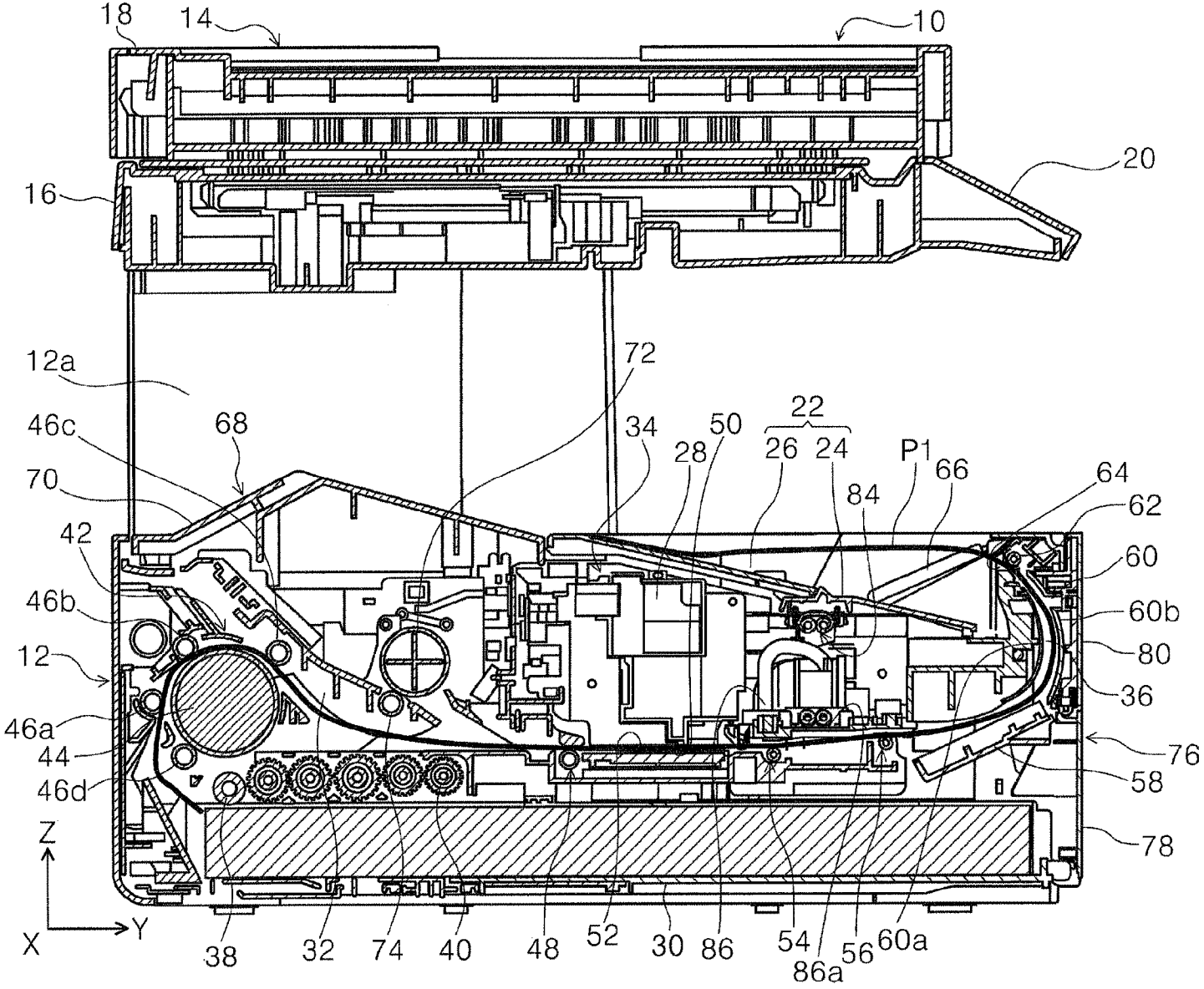
FIG. 3 is a lateral sectional diagram illustrating a medium transport path of the printer according to the embodiment.
Figure 4:
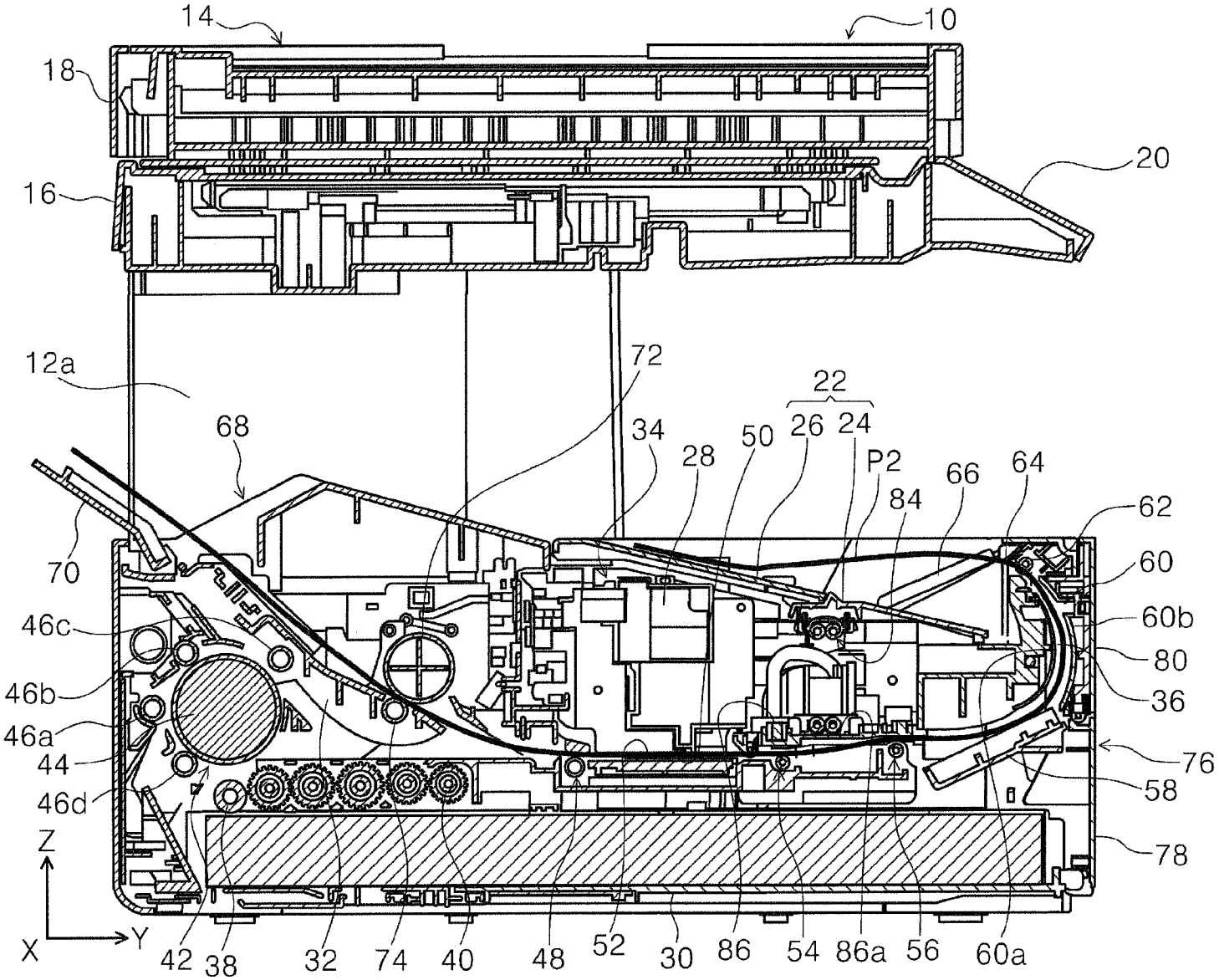
FIG. 4 is a lateral sectional diagram illustrating the medium transport path of the printer according to the embodiment.
Figure 5:
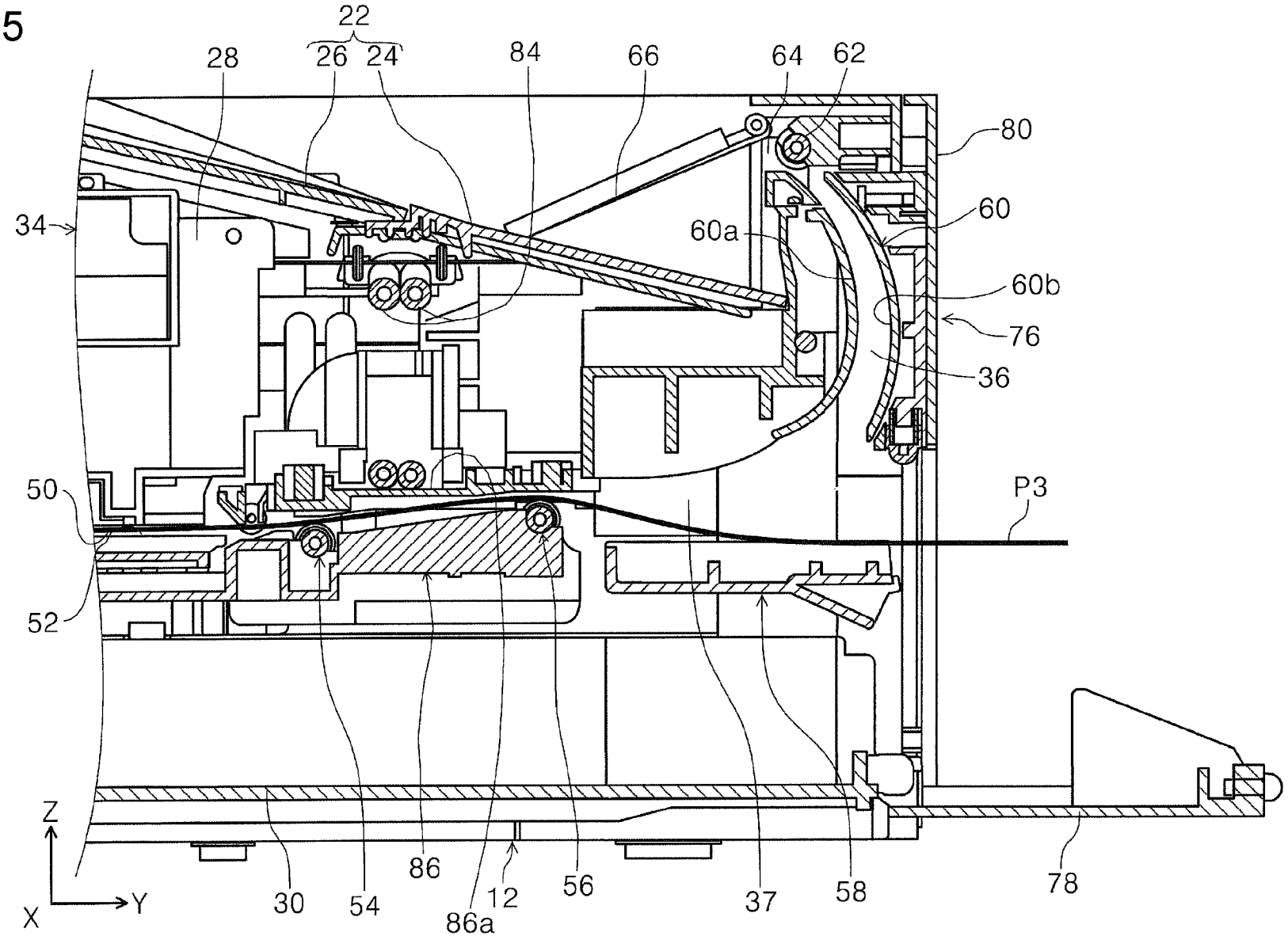
FIG. 5 is a lateral sectional diagram illustrating the medium transport path of the printer according to the embodiment.

FIG. 1 is a perspective view of a printer according to the embodiment, FIG. 2 is a perspective view illustrating a state in which a second tray is open in the printer according to the embodiment, and FIGS. 3 to 5 are lateral sectional diagrams illustrating a medium transport path of the printer according to the embodiment.

Figure 6:
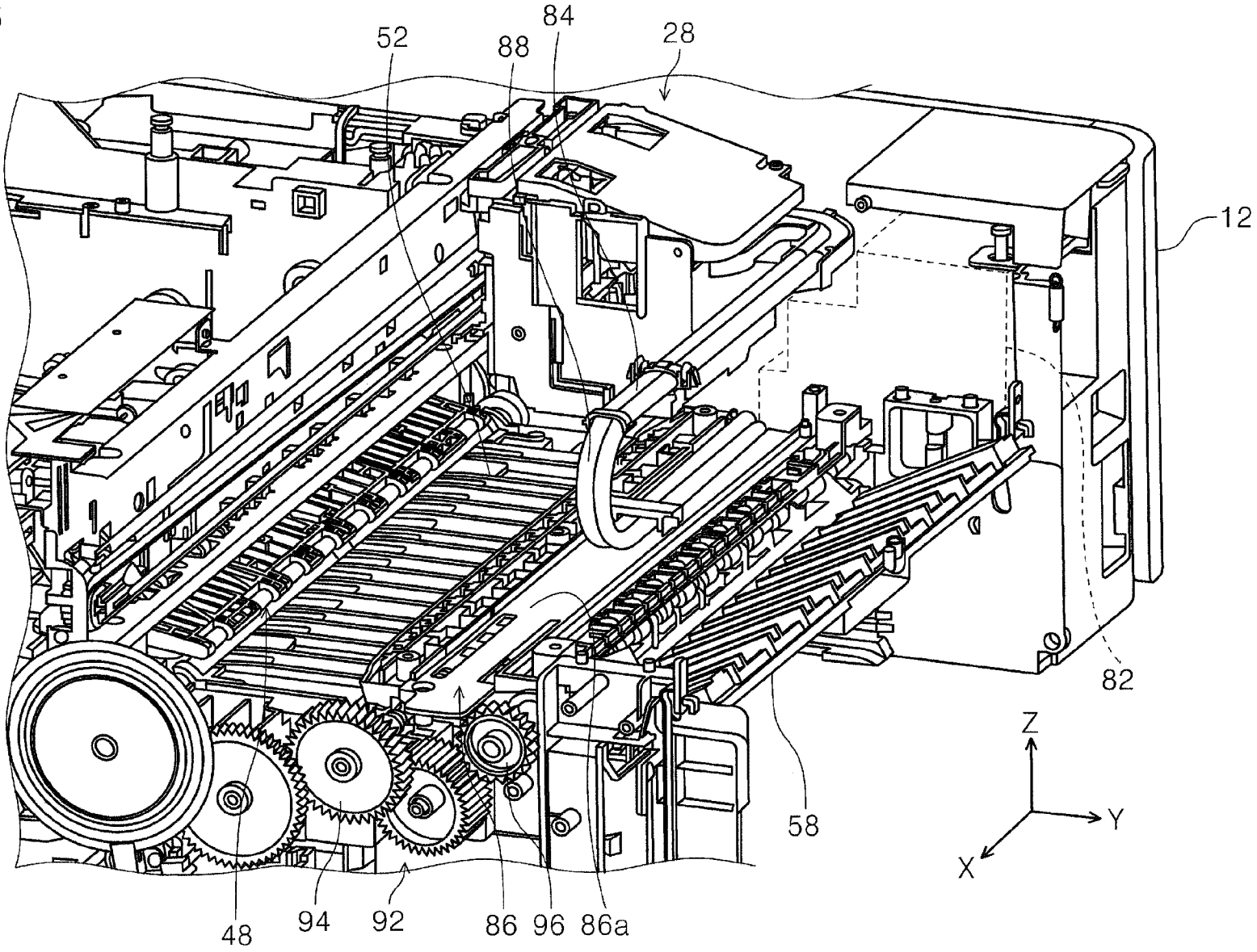
FIG. 6 is a perspective view illustrating a carriage unit in the printer and a movement region of the carriage unit.
Figure 7:
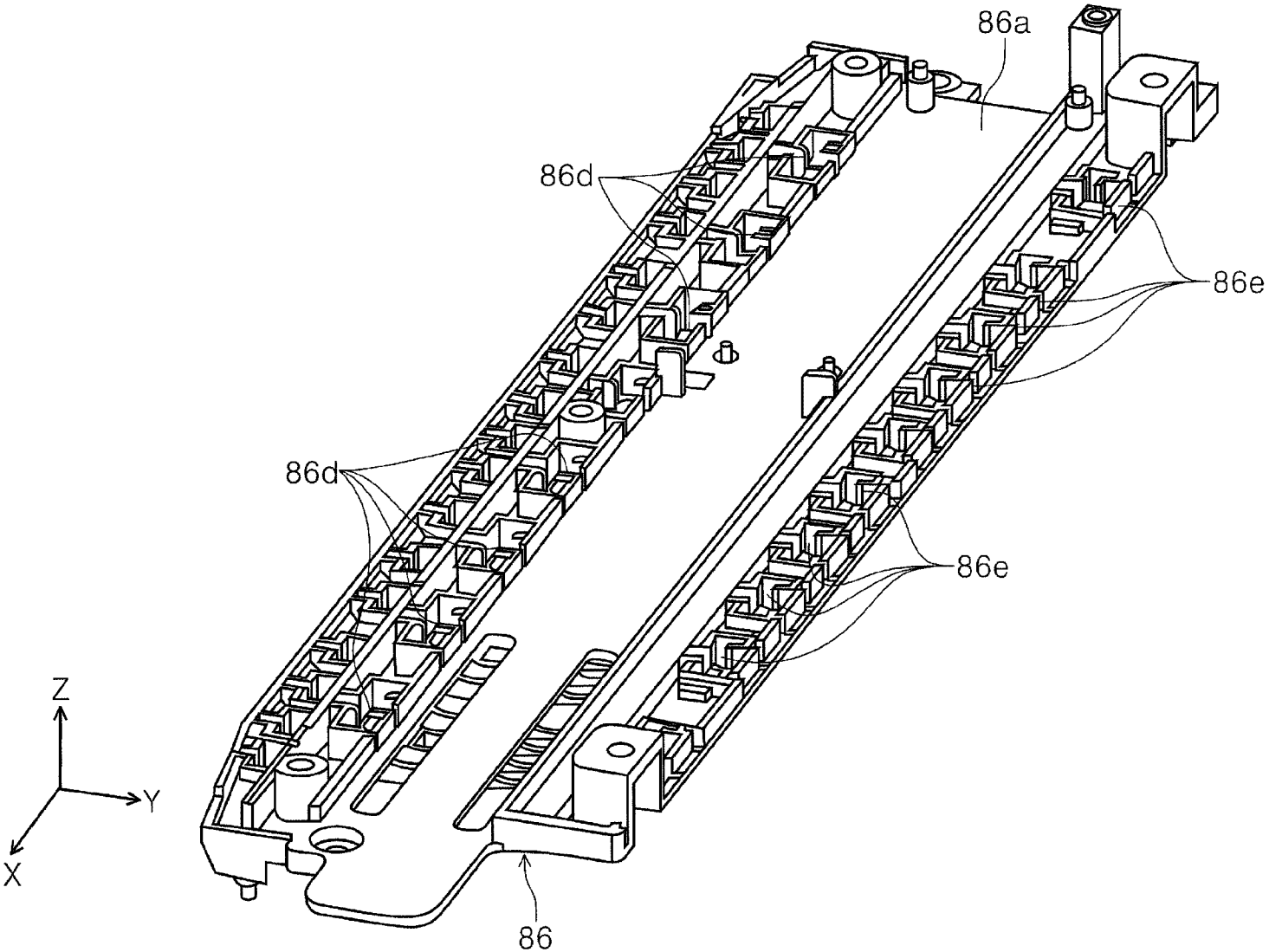
FIG. 7 is a perspective view illustrating a top surface side of a roller support frame according to the embodiment.
Figure 8:
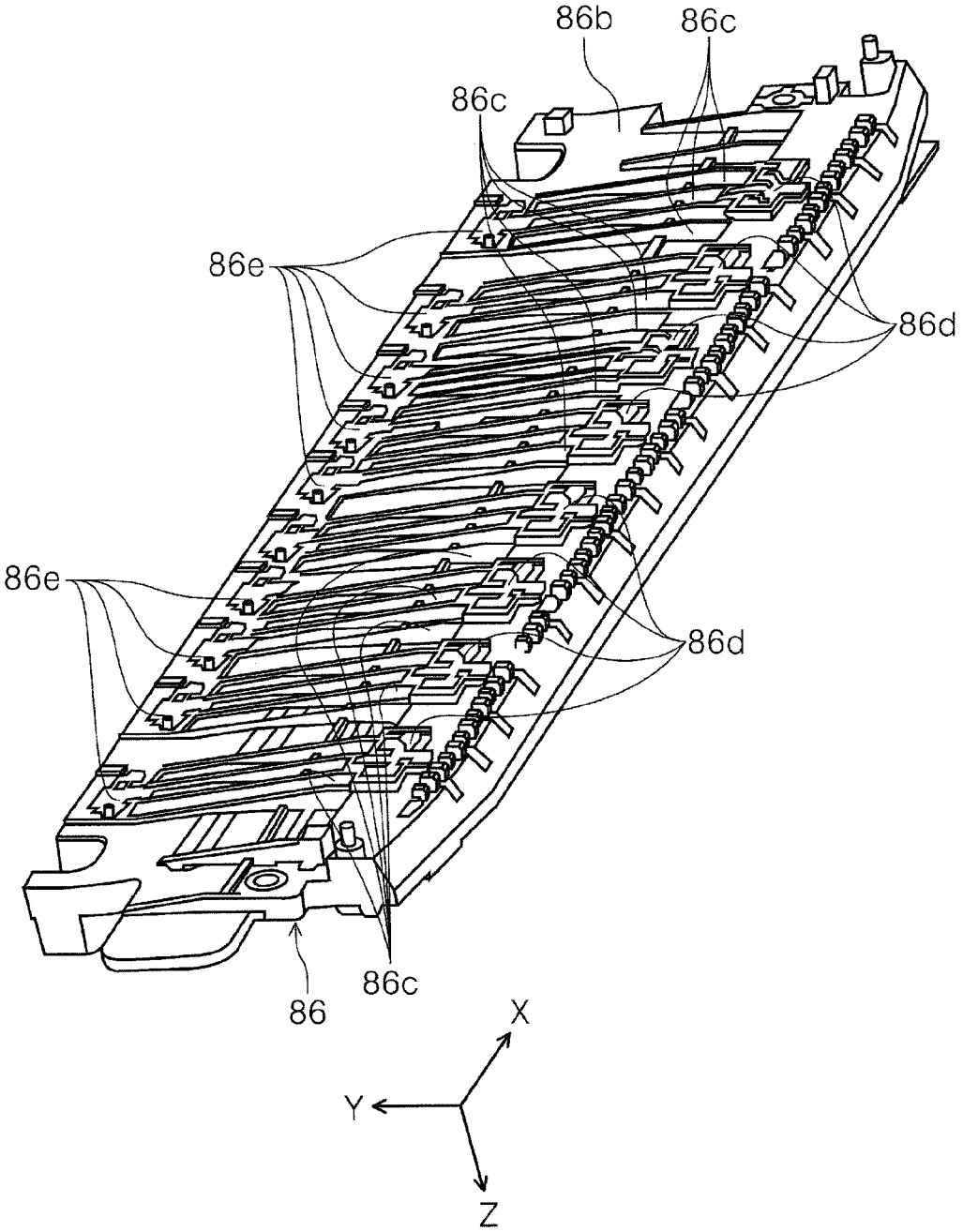
FIG. 8 is a perspective view illustrating a bottom surface side of the roller support frame according to the embodiment.
Figure 9:
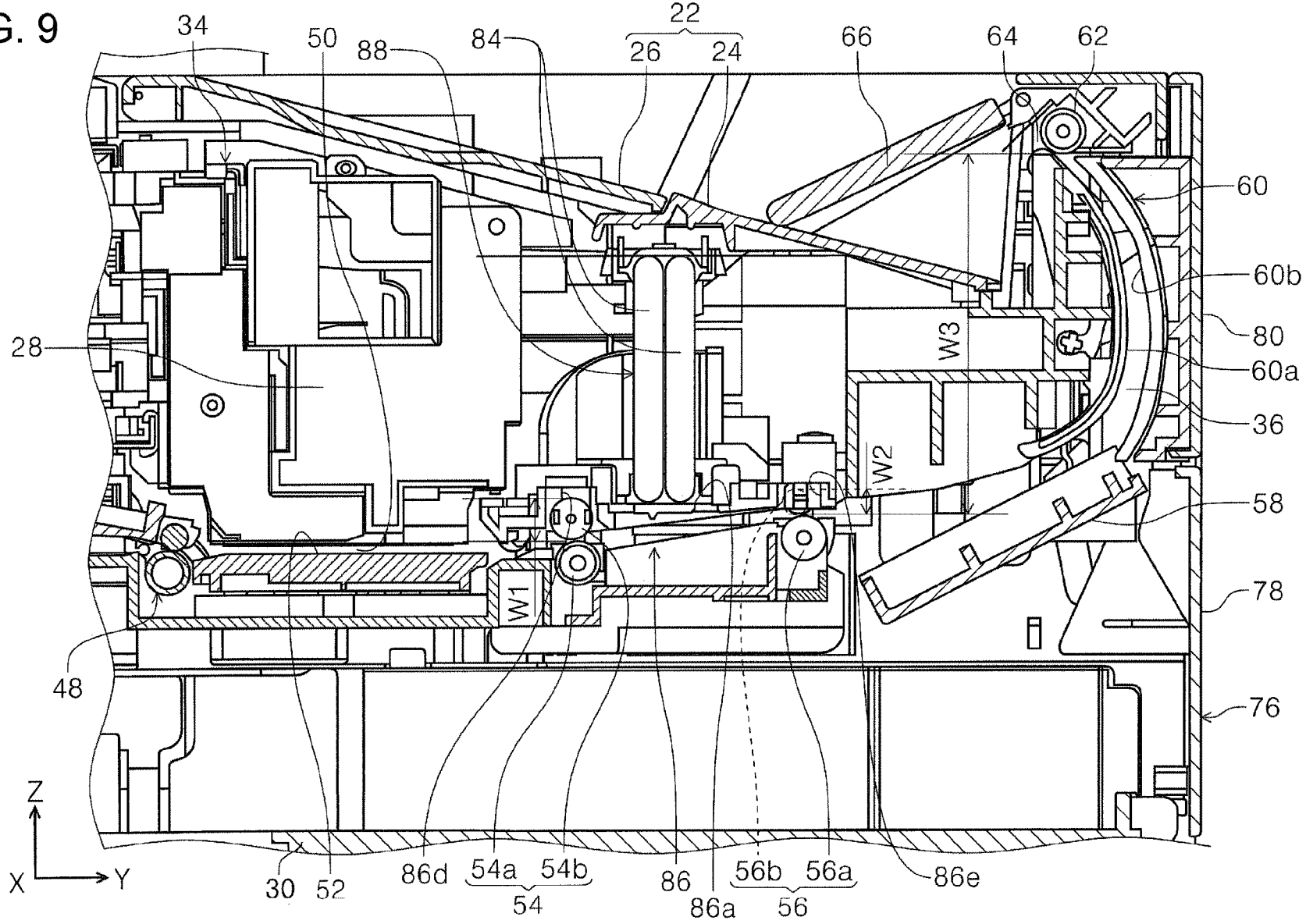
FIG. 9 is a sectional diagram illustrating the relationship between a first driven roller, a second driven roller, and a tube support surface in the roller support frame.
Figure 10:
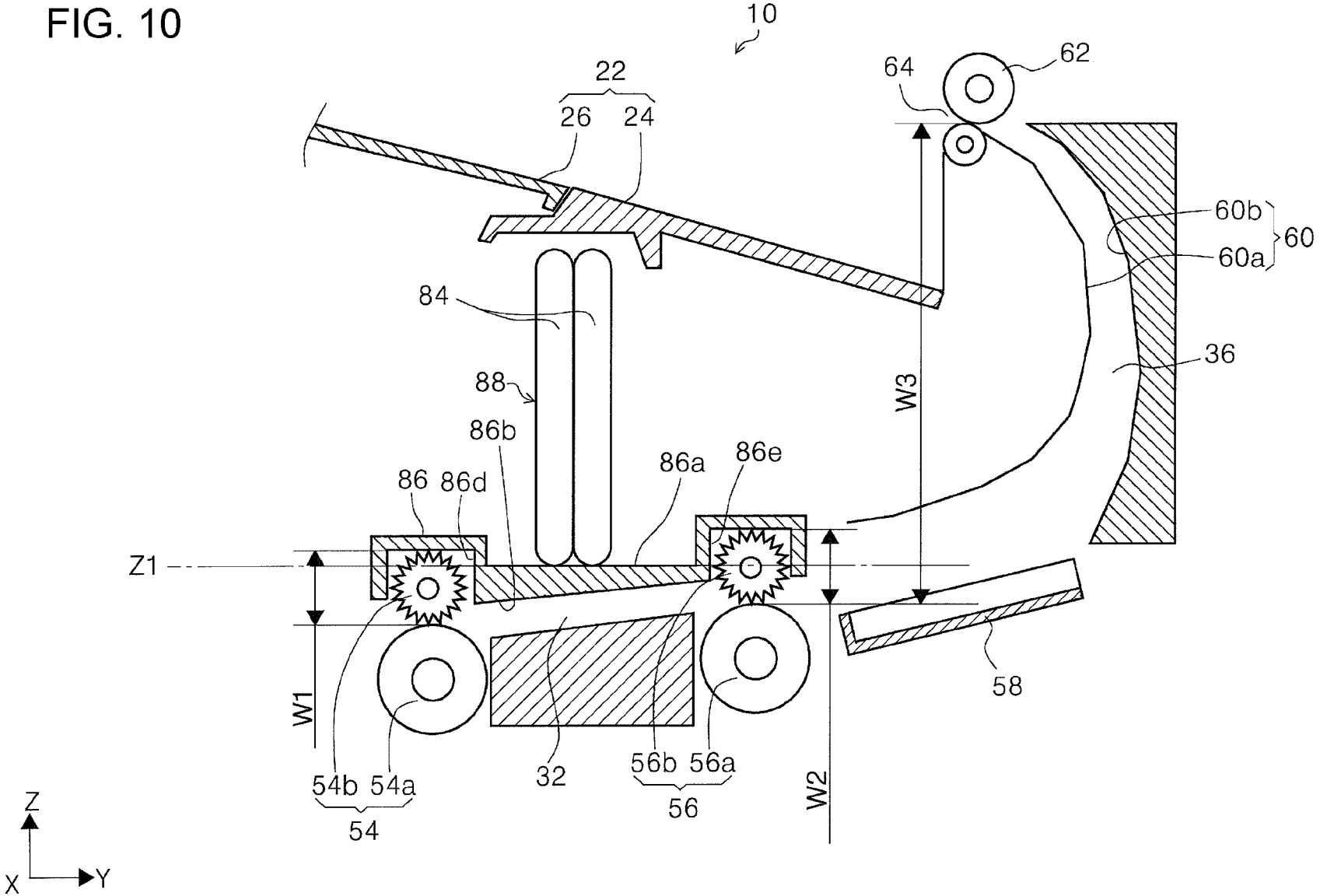
FIG. 10 is a schematic diagram describing the relationship between the first driven roller, the second driven roller, and the tube support surface in FIG. 9.

FIG. 6 is a perspective view illustrating a carriage unit in the printer and a movement region of the carriage unit, FIG. 7 is a perspective view illustrating a top surface side of a roller support frame according to the embodiment, FIG. 8 is a perspective view illustrating a bottom surface side of the roller support frame according to the embodiment, FIG. 9 is a sectional diagram illustrating the relationship between a first driven roller, a second driven roller, and a tube support surface in the roller support frame, and FIG. 10 is a schematic diagram describing the relationship between the first driven roller, the second driven roller, and the tube support surface in FIG. 9.

Figure 11:
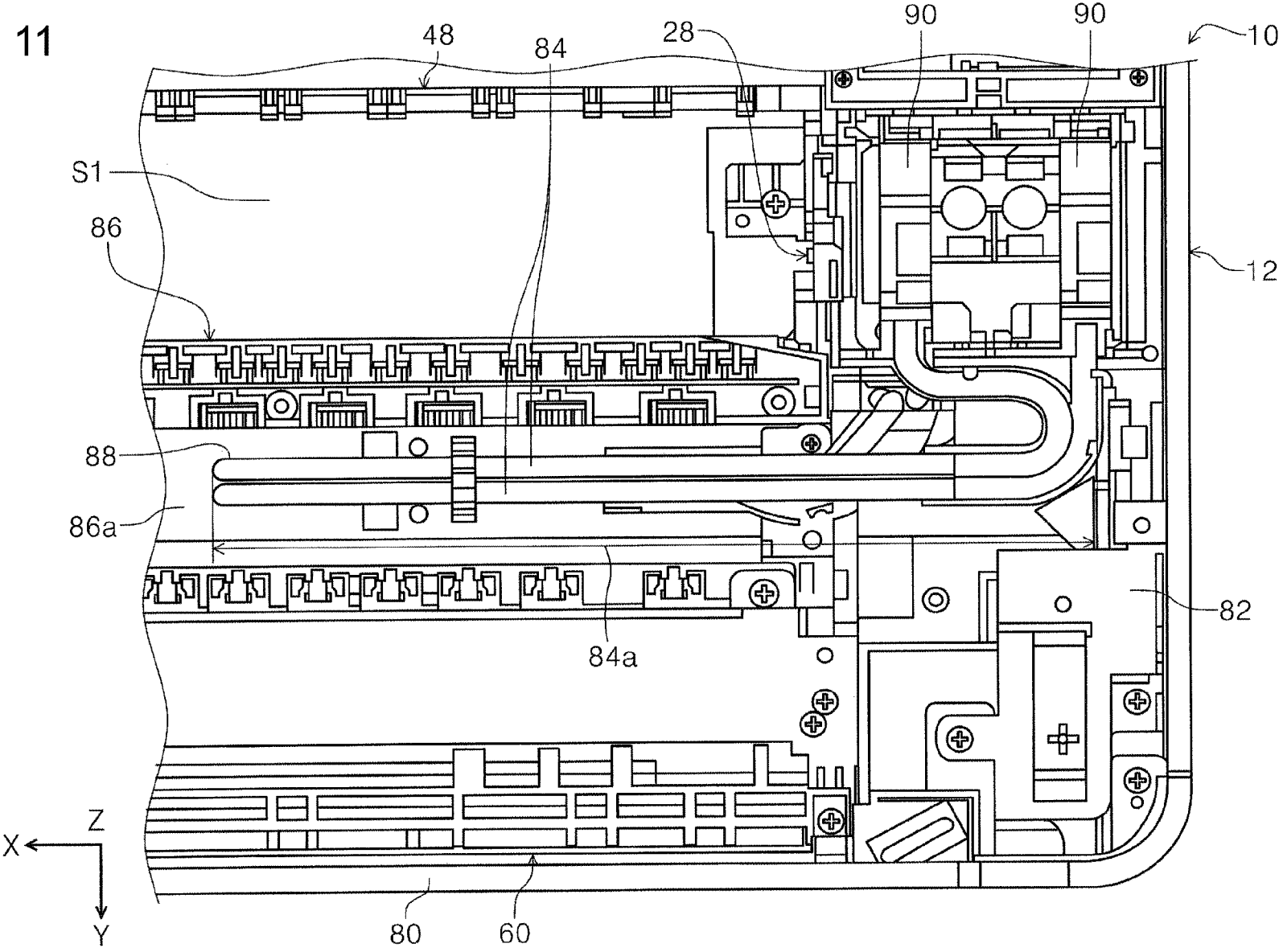
FIG. 11 is a plan view illustrating a connection portion which connects to an ink tube in the carriage unit.
Figure 12:
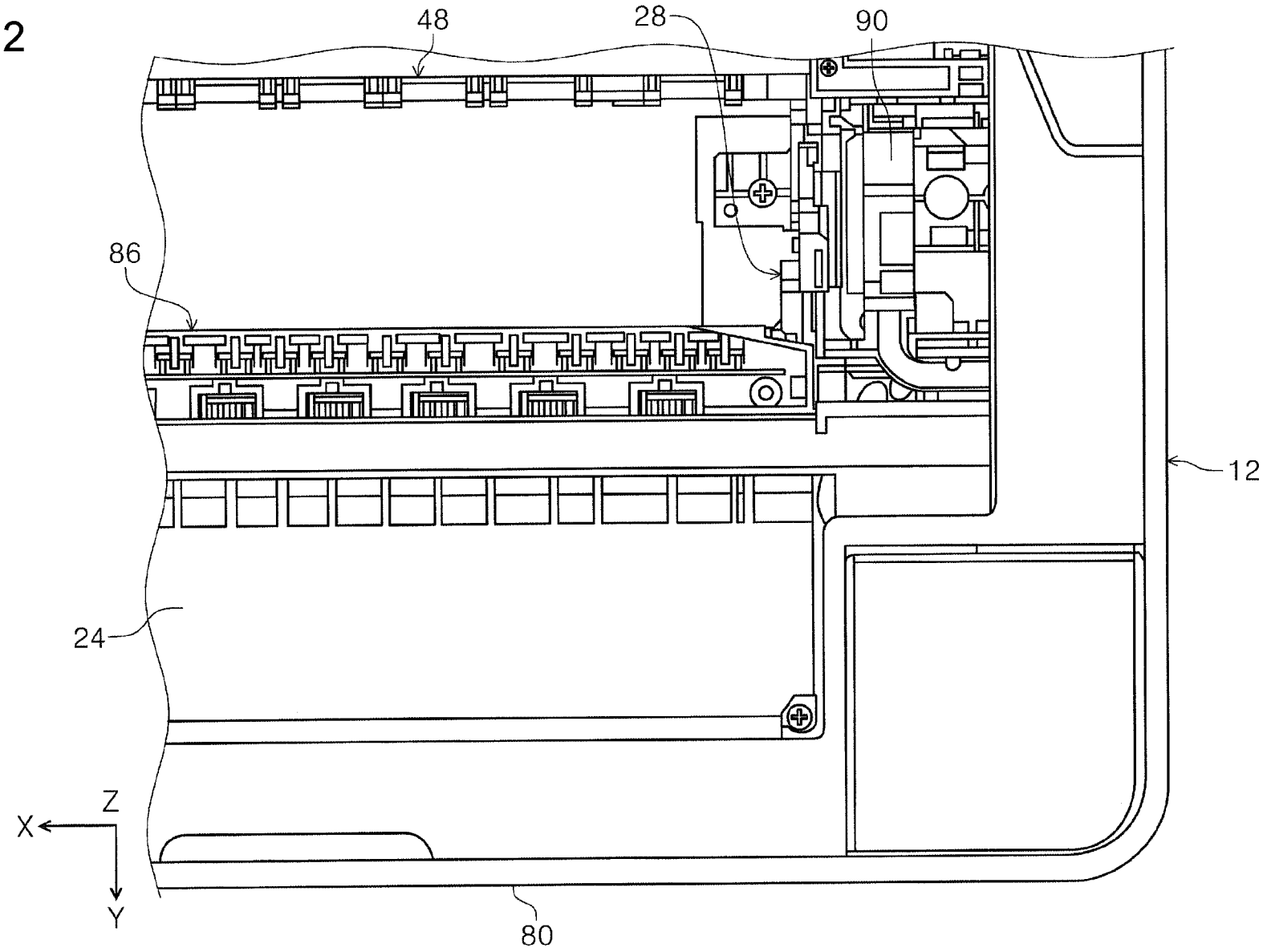
FIG. 12 is a plan view illustrating a state in which a first tray is attached to an apparatus main body in FIG. 11.
Figure 13:
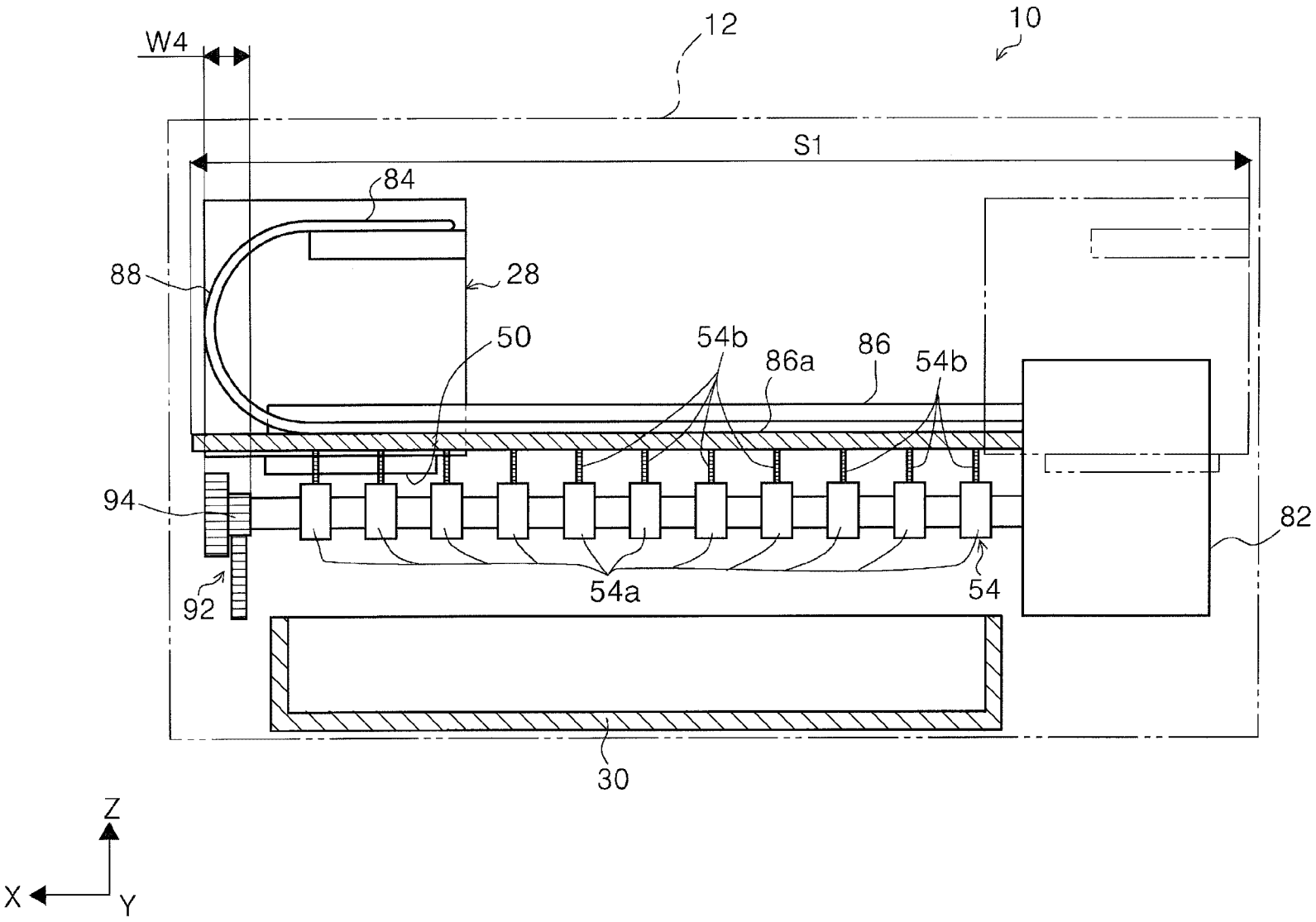
FIG. 13 is a schematic diagram illustrating the relationship between a curved portion of the ink tube and a motive force transmission unit.
Figure 14:
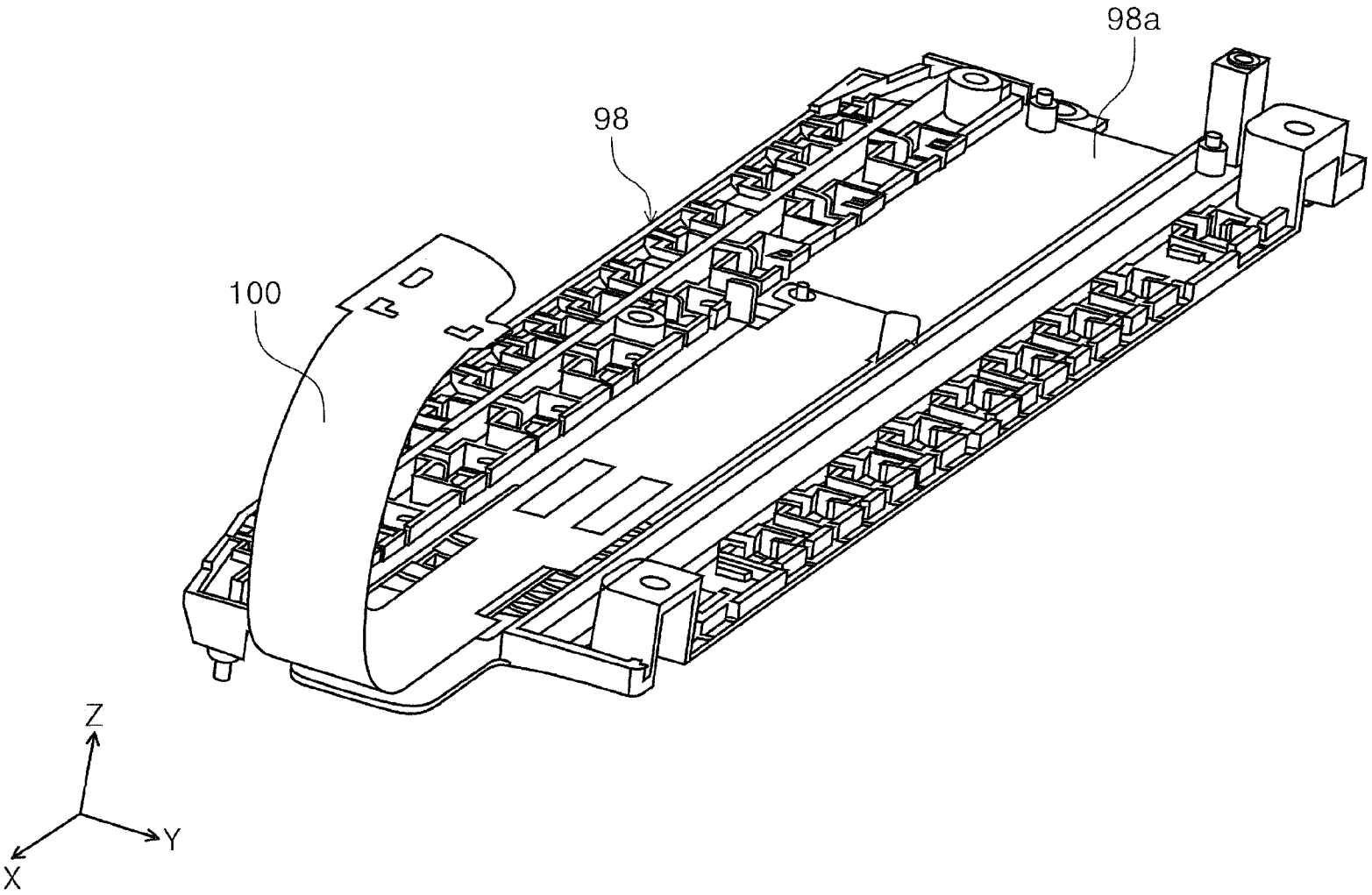
FIG. 14 is a perspective view of the roller support frame according to a modification example of the embodiment.

FIG. 11 is a plan view illustrating a connection portion which connects to an ink tube in the carriage unit, FIG. 12 is a plan view illustrating a state in which a first tray is attached to an apparatus main body in FIG. 11, FIG. 13 is a schematic diagram illustrating the relationship between a curved portion of the ink tube and a motive force transmission unit, and FIG. 14 is a perspective view of the roller support frame according to a modification example of the embodiment.

Figure 15:
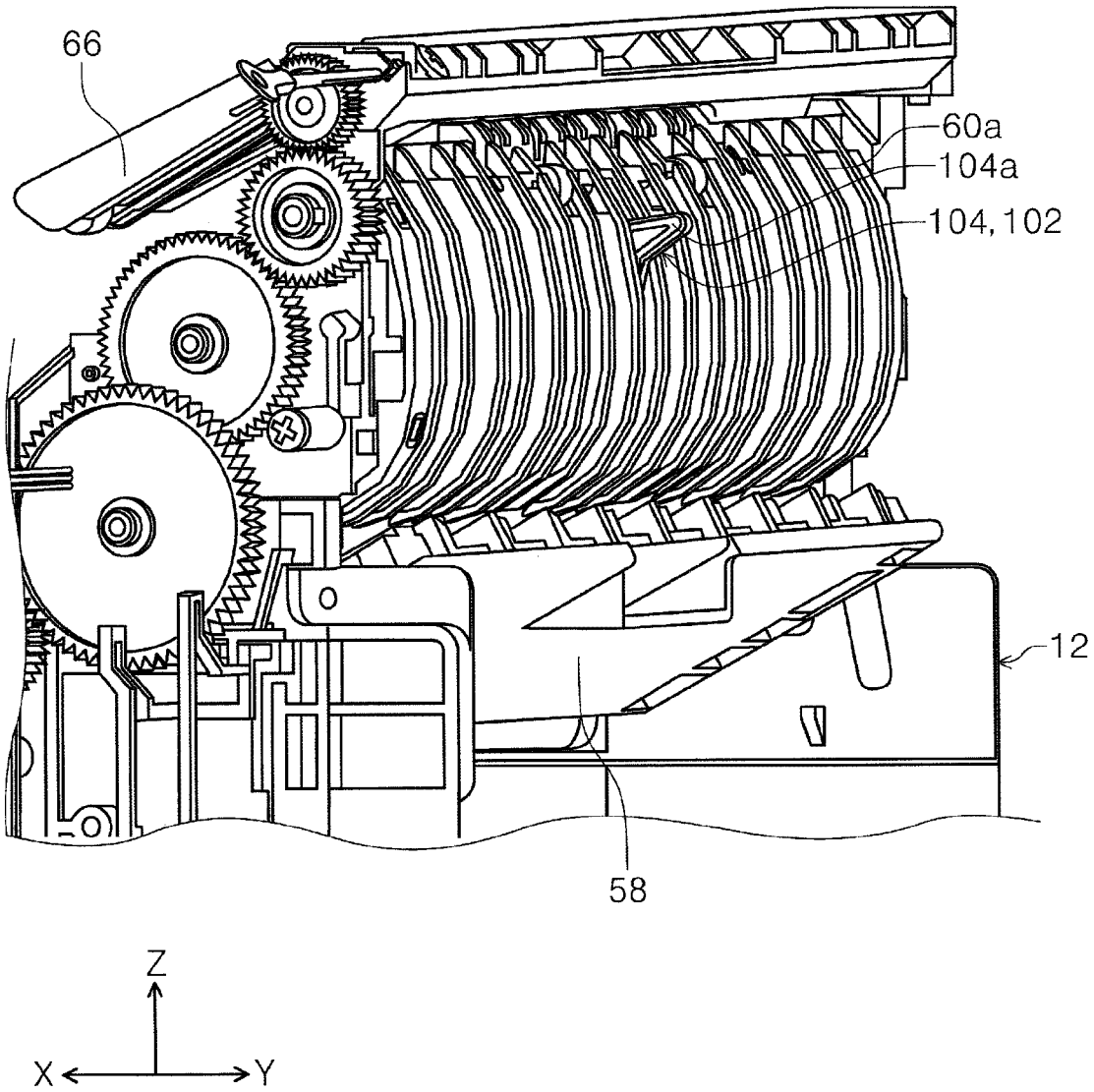
FIG. 15 is a perspective view illustrating a curved inversion path in the medium transport path.
Figure 16:
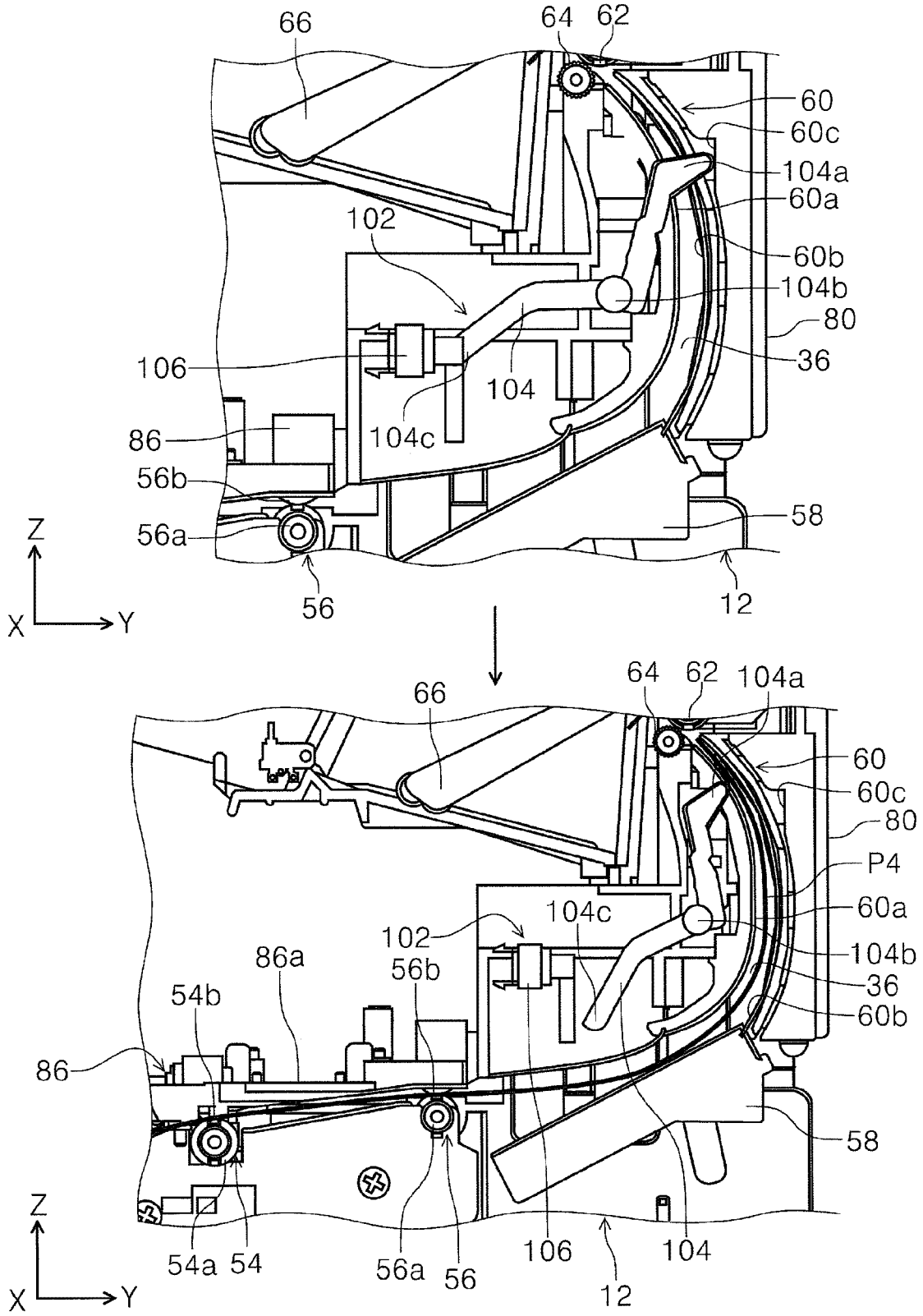
FIG. 16 is a sectional diagram illustrating the switching from a non-detecting state to a detecting state of a medium detection unit which is provided in the curved inversion path.
Figure 17:
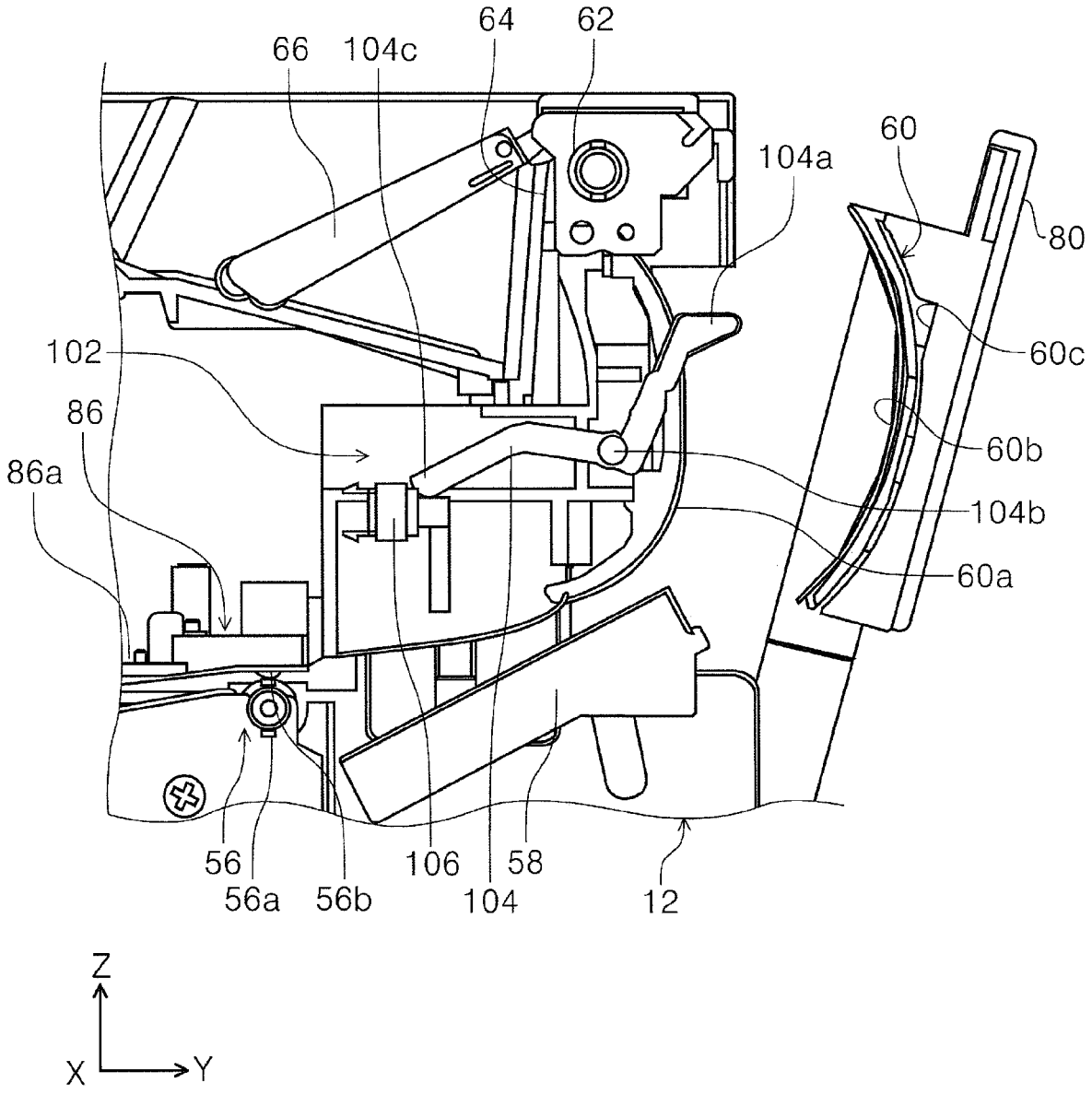
FIG. 17 is a sectional diagram illustrating a state of the medium detection unit when a portion of the curved inversion path is opened.

FIG. 15 is a perspective view illustrating a curved inversion path in the medium transport path, FIG. 16 is a sectional diagram illustrating the switching from a non-detecting state to a detecting state of a medium detection unit which is provided in the curved inversion path, and FIG. 17 is a sectional diagram illustrating a state of the medium detection unit when a portion of the curved inversion path is opened.

In an X-Y-Z coordinate system illustrated in the drawings, an X direction indicates a width direction of a recording medium, that is, an apparatus width direction, a Y direction indicates a transport direction of the recording medium in a transport path inside a recording apparatus, that is, an apparatus depth direction, and a Z direction indicates an apparatus height direction. A −X-axis direction is a first direction and a +X-axis direction is a second direction.

Embodiment

Outline of Printer

A description will be given of the overall configuration of a printer 10 with reference to FIGS. 1 and 2. The printer 10 is configured as an ink jet printer as an example of a liquid ejecting apparatus. The printer 10 is configured as a multi-function device which is provided with a housing 12 and a scanner unit 14. Support portions 12*a* which protrude in the +Z direction are formed on both end portions of the housing 12 in the X-axis direction. The scanner unit 14 is disposed above the housing 12 and is supported by the support portions 12*a*. In FIG. 2, the support portion 12*a* on the +X-axis direction side is omitted.

The scanner unit 14 is provided with a scanner main body 16 and an ADF unit 18. An operation unit 20 is provided on the end portion of the scanner main body 16 on the +Y direction side. The operation unit 20 is provided with a plurality of operation buttons and a display panel. In the embodiment, the operation unit 20 is configured such that it is possible to operate a recording action in the printer 10 and an image reading action in the scanner unit 14.

A medium receiving tray 22 is provided on the top portion of the housing 12. The medium receiving tray 22 in the embodiment is provided with a first tray 24 and a second tray 26. The first tray 24 in the embodiment is fixed to the housing 12. Meanwhile, the second tray 26 is attached to the housing 12 to be rotational movement with respect to the housing 12. In the embodiment, the medium receiving tray 22 is configured to receive the medium which is discharged from inside the housing 12 at an inclined posture (FIGS. 3 and 4). Specifically, the medium receiving tray 22 is configured to form an inclined surface which has an upward inclination (+Z-axis direction) toward the −Y-axis direction which is the discharge direction of the medium P.

In the embodiment, when the second tray 26 is switched from a state of being closed with respect to the housing 12 (FIG. 1) to an open state (FIG. 2), a carriage unit 28 (described later) and a movement region S1 of the carriage unit 28 are exposed.

Medium Transport Path

FIG. 3 describes a medium transport path 32 from a medium storage portion 30 to the medium receiving tray 22. The medium transport path 32 in the embodiment is provided with a curved inversion path 36 and a straight path 37 (FIG. 5). The curved inversion path 36 is inverted while curving from a recording unit 34 toward the +Z direction side on the downstream in the transport direction and the straight path 37 extends from the recording unit 34, toward the downstream in the transport direction, to the apparatus front surface side. A bold line which is given a reference numeral P1 in FIG. 3 indicates a path of the medium P which is transported along the medium transport path 32.

The medium storage portion 30 is provided on the end portion of the housing 12 on the −Z direction side in FIG. 3. A pickup roller 38 is provided on the +Z direction side of the medium storage portion 30. The pickup roller 38 is configured to be rotational movement using a rotational movement shaft 40 of a gear train including the pickup roller 38 as a fulcrum. The pickup roller 38 transports the medium P which is the topmost medium which is stored in the medium storage portion 30 along the medium transport path 32 to the downstream in the transport direction by coming into contact with the medium P which is stored in the medium storage portion 30.

A medium inverting unit 42 is provided on the downstream of the pickup roller 38 in the medium transport path 32. The medium inverting unit 42 is provided with an inversion roller 44 and driven rollers 46*a*, 46*b*, 46*c*, and 46*d* which are disposed in the periphery of the inversion roller 44 and are driven to rotate with respect to the inversion roller 44.

The medium P which is fed by the pickup roller 38 is fed via the medium inverting unit 42 to a transport roller pair 48 which is provided on the downstream in the transport direction. The recording unit 34 is provided on the downstream of the transport roller pair 48 in the transport direction. The carriage unit 28 is provided in the recording unit 34. The carriage unit 28 is configured to be moving in the X-axis direction and the bottom portion of the carriage unit 28 is provided with a recording head 50 which serves as "a liquid ejecting head" which discharges an ink which serves as "a liquid" in the −Z direction.

A medium support unit 52 is provided under the recording head 50 in a region facing the recording head 50. The medium support unit 52 supports the bottom surface (the surface of the opposite side from the recording surface) of the medium P which is transported to the region which faces the recording head 50 by the transport roller pair 48. The recording head 50 discharges the ink onto the medium P which is supported by the medium support unit 52 and executes the recording to the recording surface (the surface which faces the recording head 50) of the medium P.

A first discharge roller pair 54 and a second discharge roller pair 56 are provided on the downstream of the recording head 50 in the transport direction. A medium receiving tray 58 is provided on the downstream of the first discharge roller pair 54 and the second discharge roller pair 56 in the transport direction. The medium receiving tray 58 is switching between a guiding posture (FIGS. 3 and 4) and a medium receiving posture (FIG. 5). In the guiding posture, the medium receiving tray 58 guides the medium P from the recording unit 34 to the curved inversion path 36, and in the medium receiving posture, the medium receiving tray 58 configures the straight path (FIG. 5) which extends from the recording unit 34 to the apparatus front surface side and receives the medium P which is discharged by the second discharge roller pair 56. Specifically, the posture switching is performed by causing the medium receiving tray 58 to rotationally move with respect to the housing 12.

In FIG. 3, a curved inversion path forming portion 60 is provided on the downstream, more specifically, on the +Z direction side of the medium receiving tray 58 which assumes the guiding posture. In the embodiment, the curved inversion path forming portion 60 configures the curved inversion path 36 which causes the medium P to be curved and inverted.

The medium P which is fed from the recording unit 34 to the downstream by the first discharge roller pair 54 and the second discharge roller pair 56 is guided to the curved inversion path forming portion 60 by the medium receiving tray 58 in the guiding posture. The curved inversion path forming portion 60 causes the medium P to curve so as to be inverted with the recording surface, on which the recording is most recently performed in the recording unit 34, facing the inside, and discharges the medium P via a discharge roller 62 which is provided on the downstream of the curved inversion path forming portion 60 from a discharge port 64 toward the medium receiving tray 22. At this time, the medium P is discharged to the medium receiving tray 22 with the surface (a first surface) on which the recording is performed in the recording unit 34 facing downward.

In the embodiment, the curved inversion path 36 is configured as a face-down path in which the medium P is discharged from the recording unit 34 via the medium receiving tray 58 in the guiding posture and the curved inversion path forming portion 60 in a face-down state (a state in which the recording surface faces downward) toward the medium receiving tray 22.

Flaps 66 are provided on the discharge port 64 of the housing 12. The flaps 66 are configured to be capable of rotational movement with respect to the housing 12. In the embodiment, a plurality of the flaps 66 is provided leaving an interval in the X-axis direction between the flaps 66 (FIGS. 1 and 2).

In a case in which the recording is executed on the first surface (the top surface) of the medium P in the recording unit 34, the recording is performed on a second surface (the bottom surface) on the opposite side from the first surface, the transport roller pair 48 is caused to rotate in reverse and the medium P is transported to the upstream in the transport direction. The medium P which is transported to the upstream in the transport direction is returned to the medium inverting unit 42 and is nipped by the inversion roller 44 and the driven roller 46*d*. The medium P has the first surface and the second surface thereof inverted by the inversion roller 44, is transported to the recording unit 34, the recording of the second surface is executed in the recording unit 34, and subsequently, the medium P passes through the curved inversion path 36 and is discharged to the medium receiving tray 22.

Next, a description will be given of the transporting of the medium from the rear side feed unit 68 in FIG. 4. The rear side feed unit 68 is provided on the end portion of the housing 12 on the −Y direction side. The rear side feed unit 68 is provided with a feed port cover 70. The feed port cover 70 is configured to be capable of rotational movement with respect to the housing 12 and is capable of switching between a closed state (FIG. 3) and an open state (FIG. 4). By adopting the state in which the feed port cover 70 is open, it is possible to feed the medium P from the rear side feed unit 68 toward the recording unit 34 inside the housing 12. A bold line which is given a reference numeral P2 in FIG. 4 indicates a path of the medium P which is fed from the rear side feed unit 68.

A feed roller 72 and a separation roller 74 are provided on the downstream of the feed port cover 70. The medium P which is set in the rear side feed unit 68 is nipped by the feed roller 72 and the separation roller 74 and meets the medium transport path 32 on the downstream of the feed roller 72 and the separation roller 74. Subsequently, the medium P is fed to the recording unit 34, the recording is performed, the medium P passes through the curved inversion path 36, and is discharged to the medium receiving tray 22.

Here, a description will be given of the straight path 37 (FIG. 5). In FIGS. 1 and 2, a cover 76 is provided on the front surface side of the housing 12. In the embodiment, the cover 76 includes a rotational movement fulcrum on the bottom portion of the cover 76 and is configured such that the top portion serves as the free end of the rotational movement. The cover 76 is provided with a first cover 78 which is positioned on the −Z direction side and a second cover 80 which is positioned on the +Z direction side of the first cover 78 in a state in which the cover 76 is closed with respect to the housing 12 (FIGS. 1, 2, and the like).

In the embodiment, the first cover 78 is configured to be capable of rotational movement with respect to the housing 12 independently of the second cover 80. Specifically, the first cover 78 is configured to be capable of switching from a state in which only the first cover 78 is closed by rotationally moving only the first cover 78 to an open state (FIG. 5) while maintaining a state in which the second cover 80 is closed with respect to the housing 12.

In the embodiment, when the first cover 78 is opened by rotationally moving the first cover 78 to the +Y direction side of the housing 12 as illustrated in FIG. 5, it becomes possible to access the medium receiving tray 58 from the +Y direction side of the housing 12. In this state, the straight path 37 is configured by switching the medium receiving tray 58 from the guiding posture (FIGS. 3 and 4) in which the medium receiving tray 58 is inclined to the +Z direction side to a medium receiving posture (FIG. 5) in which the medium receiving tray 58 is rotationally moved to the −Z direction side and is a posture in which the medium receiving tray 58 goes along the Y-axis direction. Accordingly, it is possible to discharge the medium which is subjected to recording in the recording unit 34 to the +Y direction side of the housing 12 in a state in which the recording surface faces the +Z direction side (a face-up state). A bold line which is given a reference numeral P3 in FIG. 5 indicates a path of the medium P which is transported along the straight path 37.

Regarding Configuration of Carriage Unit and Ink Storage Unit

In FIG. 6, an ink tank 82 which serves as "a liquid storage container" is provided on the +Y direction side end portion of the housing 12 on the −X direction side end portion. In the embodiment, the ink which serves as "the liquid" is stored in the ink tank 82.

In FIG. 6, at least an end of one or more ink tubes 84 which serve as "the tube" is connected to the ink tank 82. In the embodiment, for example, two ink tubes 84 are connected to the ink tank 82. As illustrated in FIG. 6, the ink tubes 84 extend in the +X-axis direction along a tube support surface 86*a* of a roller support frame 86 (described later).

After extending in the +X-axis direction, the ink tubes 84 change orientation to the +Z direction side and extend to the −X direction side while curving. In the embodiment, a portion at which the ink tubes 84 curve on the +X direction side is a curved portion 88. The ink tubes 84 which extend from the curved portion 88 to the −X direction side are connected to adapters 90 (FIG. 11), at least one or more adapters 90 being provided on the top portion of the carriage unit 28.

Regarding Roller Support Frame and Tube Support Surface

Here, a description will be given of the roller support frame 86 and the tube support surface 86*a* in FIGS. 7 to 10. In FIG. 7, the roller support frame 86 is configured as a flat plate-shaped member which extends along the X-axis direction. The tube support surface 86*a* which extends along the X-axis direction is formed on the top surface side of the roller support frame 86.

In FIG. 8, a plurality of ribs 86*c* which extends along the Y-axis direction is provided on a bottom surface 86*b* of the roller support frame 86 leaving an interval, as appropriate, in the X-axis direction between the ribs 86*c*. In the embodiment, the bottom surface 86*b* of the roller support frame 86 configures a portion of the medium transport path 32.

On the bottom surface 86*b* of the roller support frame 86, a plurality of first driven roller attachment portions 86*d* is provided on the upstream of the ribs 86*c* in the Y-axis direction, and a plurality of second driven roller attachment portions 86*e* is provided no the downstream of the ribs 86*c*. The driven roller attachment portions of the plurality of first driven roller attachment portions 86*d* and the plurality of second driven roller attachment portions 86*e* are respectively disposed to leave an interval, as appropriate, in the X-axis direction.

In FIG. 9, the downstream side of the carriage unit 28 in the medium transport direction (the +Y direction side) inside the housing 12 is provided with a first drive roller 54*a* of the first discharge roller pair 54 and a second drive roller 56*a* of the second discharge roller pair 56 which is provided to leave an interval on the +Y direction side with respect to the first drive roller 54*a*. In the embodiment, the roller support frame 86 is disposed above a region in which the first drive roller 54*a* and the second drive roller 56*a* are provided in the Y-axis direction.

As illustrated in FIG. 10, a first driven roller 54*b* of the first discharge roller pair 54 is attached to the first driven roller attachment portion 86*d* of the roller support frame 86 to be capable of being driven to rotate by the first drive roller 54*a*. A second driven roller 56*b* of the second discharge roller pair 56 is attached to the second driven roller attachment portion 86*e* of the roller support frame 86 to be capable of being driven to rotate by the second drive roller 56*a*. In the embodiment, the first driven roller 54*b* and the second driven roller 56*b* are configured as spurs, for example.

In FIG. 10, the tube support surface 86*a* of the roller support frame 86 is disposed between the first driven roller 54*b* and the second driven roller 56*b* in the Y-axis direction. The tube support surface 86*a* in the embodiment is set to a height position Z1 (a dot-dash line in FIG. 10) in the Z-axis direction. Here, the height position Z1 of the tube support surface 86*a* is positioned inside a region W1 in which the first driven roller 54*b* is provided and a region W2 in which the second driven roller 56*b* is provided. In other words, the tube support surface 86*a* overlaps the first driven roller 54*b* and the second driven roller 56*b* in the Z-axis direction.

As illustrated in FIG. 10, in the embodiment, the curved portion 88 of the ink tubes 84 is positioned inside a region W3 which is formed in the curved inversion path 36 in the Z-axis direction. In the curved inversion path 36 in the embodiment, the second discharge roller pair 56 is set as a starting point and the discharge roller 62 is set as an ending point in the medium transport direction, for example. In the embodiment, the region W3 which is formed in the curved inversion path 36 is set as a region from the nipping position of the second discharge roller pair 56 to the bottom portion of the discharge roller 62 in the Z-axis direction, for example. In the embodiment, the curved portion 88 of the ink tubes 84 is configured to be positioned inside the region W3 which is formed in the curved inversion path 36 in the Z-axis direction. However, the configuration is not limited thereto, and a configuration may be adopted in which at least a portion of the curved portion 88 is positioned inside the region W3.

As illustrated in FIGS. 6 and 11, a section 84*a* (FIG. 11) which extends in the −X direction from the curved portion 88 in the ink tubes 84 and is connected to the carriage unit 28 is disposed on the +Y direction side of the carriage unit 28 in the Y-axis direction. As illustrated in FIG. 12, in a state in which the first tray 24 is mounted in the housing 12, the first tray 24 is positioned above the section 84*a* of the ink tubes 84 and covers the section 84*a*. Specifically, as illustrated in FIGS. 9 and 10, the ink tubes 84 are positioned on the discharge direction downstream end portion under (on the reverse side of) the first tray 24 (the end portion of the first tray 24 on the −Y direction side).

Here, as illustrated in FIGS. 9 and 10, the first tray 24 is configured to be inclined upward toward the −Y-axis direction which is the discharge direction of the medium P. In other words, since the first tray 24 is configured to increase in height toward the −Y-axis direction, the space under the first tray 24 also increases in size heading toward the −Y-axis direction. In the embodiment, since the ink tubes 84 are disposed under the end portion of the first tray 24 on the −Y-axis direction side, it is possible to increase the curvature radius of the curved portion 88 of the ink tubes 84. As a result, when the carriage unit 28 is moved in the X-axis direction, since it is possible to decrease the sliding resistance which is generated by the ink tubes 84 being pushed by the tube support surface 86*a*, it is possible to allow the movement of the carriage unit 28 to be smooth.

Even in a state in which the second tray 26 is opened to expose the carriage unit 28 and the movement region S1 of the carriage unit 28 as illustrated in FIGS. 2 and 12, since the first tray 24 covers the top of the ink tubes 84 and conceals the ink tubes 84, it is possible to suppress unintentional access (access by the user) to the ink tubes 84.

In other words, in a case in which the second tray 26 is opened to perform paper jam processing or the like, when the user accidentally touches the ink tubes 84, there is a concern that the user will accidentally pull the ink tubes 84 out from the carriage unit 28 or the like. However, as described above, since the ink tubes 84 are in a state of being concealed on the bottom side of the first tray 24 even if the second tray 26 is opened, it is possible to avoid unintentional access to the ink tubes 84 and it is possible to suitably maintain ink flow paths.

Regarding Relationship Between Motive Force Transmission Unit of Drive Roller and Ink Tubes In FIGS. 6 and 13, a motive force transmission unit 92 which rotationally drives the transport roller pair 48, the first discharge roller pair 54, and the second discharge roller pair 56 is disposed on the end portion of the housing 12 on the +X-axis direction side. The motive force transmission unit 92 in the embodiment is configured to transmit the driving force from a drive source (not illustrated) which is provided inside the housing 12 to the respective drive rollers of the transport roller pair 48, the first discharge roller pair 54, and the second discharge roller pair 56. FIG. 13 schematically illustrates the housing 12.

As illustrated in FIG. 6, the motive force transmission unit 92 is configured by, for example, a first drive gear 94, a second drive gear 96, and a plurality of other transmission gears. In the embodiment, the first drive gear 94 transmits the motive force to the first drive roller 54*a* of the first discharge roller pair 54 and drives the first drive roller 54*a* to rotate. The second drive gear 96 transmits the motive force to the second drive roller 56*a* of the second discharge roller pair 56 and drives the second drive roller 56*a* to rotate.

In FIG. 13, in a case in which the carriage unit 28 is moved to the end portion on the +X-axis direction side, the curved portion 88 of the ink tubes 84 which extend in the +X-axis direction from the carriage unit 28 and at least a portion of the carriage unit 28 are positioned inside a range of a region W4 in which the motive force transmission unit 92 is provided in the X-axis direction. In other words, when the carriage unit 28 moves to the end portion on the +X-axis direction side, at least a portion of the carriage unit 28 and the motive force transmission unit 92 overlap in the X-axis direction. The curved portion 88 of the ink tubes 84 overlaps the motive force transmission unit 92 in the X-axis direction. As a result, since the motive force transmission unit 92 is disposed inside the movement region S1 of the carriage unit 28, it is possible to obtain a reduction in the size of the printer 10 in the X-axis direction.

To summarize the above description, the printer 10 includes the carriage unit 28 which is provided with the recording head 50 which ejects the ink onto the medium P, the carriage unit 28 to move reciprocally in the X-axis direction which is a scanning direction of the recording head 50, the ink tank 82 which is capable of storing the ink to be ejected from the recording head 50, the ink tubes 84 which are connected to the carriage unit 28 and which supply the liquid which is fed from the ink tank 82 to the carriage unit 28, the first driven roller 54*b* which is provided on the downstream of the recording head 50 in the medium transport path 32 and which comes into contact with a surface (the recording surface) of the medium P which faces the recording head 50, and the tube support surface 86*a* which is positioned closer to the bottom side than the carriage unit 28 in the Z-axis direction, is provided to extend along the X-axis direction which is the movement direction of the carriage unit 28, and supports the ink tubes 84. Setting the −X-axis direction which is one direction in the X-axis direction which is the movement direction of the carriage unit 28 to a first direction and the +X-axis direction which is the other direction to a second direction, the ink tubes 84 extend along the tube support surface 86*a* toward the +X-axis direction, form the curved portion 88 which curves toward the +Z-axis direction, turns in the −X-axis direction, and is connected to the carriage unit 28. The tube support surface 86*a* is positioned to be deviated from the first driven roller 54*b* in the Y-axis direction, specifically, the +Y-axis direction side, and falls within the height range W1 of the first driven roller 54*b* in the Z-axis direction.

According to this configuration, the tube support surface 86*a* which supports the ink tubes 84 is positioned to be deviated from the first driven roller 54*b* in the Y-axis direction, specifically, the +Y-axis direction side, and falls within the height range W1 of the first driven roller 54*b* in the Z-axis direction, and so, it is possible to dispose the ink tubes 84 which are supported by the tube support surface 86*a* at a low position. As a result, it is possible to secure the curvature radius of the curved portion 88 which is formed in the ink tubes 84, and so it is possible to suppress an increase in the size (the height direction dimension) of the apparatus.

The printer 10 is provided with the roller support frame 86 which supports the first driven roller 54*b*. The tube support surface 86*a* is formed by the roller support frame 86. In this configuration, it is not necessary to provide a dedicated part which forms the tube support surface 86*a* and it is possible to obtain cost reductions.

The printer 10 is provided with the second driven roller 56*b* on the downstream side of the first driven roller 54*b* in the medium transport path 32, the second driven roller 56*b* contacting the surface of the medium P which faces the recording head 50. The tube support surface 86*a* is positioned between the first driven roller 54*b* and the second driven roller 56*b* in the Y-axis direction.

The tube support surface 86*a* is inside the height range W2 of the second driven roller 56*b* in the Z-axis direction. In this configuration, it is possible to secure the curvature radius of the curved portion 88 which is formed in the ink tubes 84 more so than in the related art, and so it is possible to suppress an increase in the size of the apparatus.

The bottom surface 86*b* of the roller support frame 86 forms a portion of the medium transport path 32.

The printer 10 is provided with the curved inversion path 36 which is provided closer to the downstream than the first driven roller 54*b* in the medium transport path 32 and which causes the medium P to curve so as to be inverted with the surface of the medium P on which recording is recently performed facing an inside, and the discharge roller 62 which discharges the medium P which is curved and inverted by the curved inversion path 36.

The curved portion 88 which is formed in the ink tubes 84 falls within the height range W3 of the curved inversion path 36 in the Z-axis direction. In this configuration, it is possible to suppress the apparatus height direction dimension.

The printer 10 is provided with the medium receiving tray 22 which is inclined to face upward along the discharge direction of the medium P by the discharge roller 62 and receives the medium P which is discharged by the discharge roller 62, and the medium receiving tray 22 is configured to include the first tray 24 which is positioned on the upstream in the discharge direction and is provided in a fixed manner, and the second tray 26 which is positioned on the downstream of the first tray 24 in the discharge direction, is provided to be capable of opening and closing, and exposes the movement region S1 of the carriage unit 28 by opening. The section 84*a* (FIG. 11) of the ink tubes 84 which turns in the −X-axis direction from the curved portion 88 and is connected to the carriage unit 28 is disposed in an end portion region on a downstream in the discharge direction on a reverse side of the first tray 24.

In this configuration, since the section 84*a* of the ink tubes 84 which turns in the −X-axis direction from the curved portion 88 and is connected to the carriage unit 28 is disposed in an end portion region on a downstream in the discharge direction on a reverse side of the first tray 24, the ink tubes 84 assume a state of being concealed on the reverse side of the first tray 24 when the second tray 26 is opened, it is possible to avoid unintentional access to the ink tubes 84, and it is possible to suitably maintain the ink flow paths.

Since the section 84*a* of the ink tubes 84 which turns in the −X-axis direction from the curved portion 88 and is connected to the carriage unit 28 is disposed in an end portion region on a downstream in the discharge direction on the reverse side of the first tray 24, by disposing the ink tubes 84 in a space in which it is possible to secure the greatest height direction dimension on the reverse side of the first tray 24, it is possible to secure the curvature radius of the curved portion 88 which is formed in the ink tubes 84, and so, it is possible to suppress an increase in the size (the height direction dimension) of the apparatus.

The printer 10 includes the carriage unit 28 which is provided with the recording head 50 which ejects the ink onto the medium P, the carriage unit 28 to move reciprocally in the X-axis direction which is the scanning direction of the recording head 50, the ink tank 82 which is capable of storing the ink to be ejected from the recording head 50, the ink tubes 84 which are connected to the carriage unit 28 and which supply the liquid which is fed from the ink tank 82 to the carriage unit 28, the tube support surface 86*a* which is positioned closer to the bottom side than the carriage unit 28 in the Z-axis direction, is provided to extend along the X-axis direction which is the movement direction of the carriage unit 28, and supports the ink tubes 84, the curved inversion path 36 which is provided closer to the downstream than the recording head 50 in the medium transport path 32 and which causes the medium P to curve so as to be inverted with the surface of the medium P on which recording is recently performed facing an inside, the discharge roller 62 which discharges the medium P which is curved and inverted by the curved inversion path 36, and the medium receiving tray 22 which is inclined upward along the discharge direction of the medium P by the discharge roller 62 and which receives the medium P which is discharged by the discharge roller 62. Setting the −X-axis direction which is one direction in the X-axis direction which is the movement direction of the carriage unit 28 to a first direction and the +X-axis direction which is the other direction to a second direction, the ink tubes 84 extend along the tube support surface 86*a* toward the +X-axis direction, form the curved portion 88 which curves toward the +Z-axis direction, turns in the −X-axis direction, and is connected to the carriage unit 28. The medium receiving tray 22 is configured to include the first tray 24 which is positioned on the upstream in the discharge direction and is provided in a fixed manner. The section 84*a* of the ink tubes 84 which turns in the −X-axis direction from the curved portion 88 and is connected to the carriage unit 28 is disposed in an end portion region to the downstream in the discharge direction on a reverse side of the first tray 24.

In this configuration, since the section 84*a* of the ink tubes 84 which turns in the −X-axis direction from the curved portion 88 and is connected to the carriage unit 28 is disposed in an end portion region on a downstream in the discharge direction on the reverse side of the first tray 24, by disposing the ink tubes 84 in a space in which it is possible to secure the greatest height direction dimension on the reverse side of the first tray 24, it is possible to secure the curvature radius of the curved portion 88 which is formed in the ink tubes 84, and so, it is possible to suppress an increase in the size (the height direction dimension) of the apparatus.

The medium receiving tray 22 is configured to include the second tray 26 which is positioned on the downstream of the first tray 24 in the discharge direction, is provided to be capable of opening and closing, and exposes the movement region S1 of the carriage unit 28 by opening.

In this configuration, since the medium receiving tray 22 is configured to include the second tray 26 which is positioned on the downstream of the first tray 24 in the discharge direction, is provided to be capable of opening and closing, and exposes the movement region S1 of the carriage unit 28 by opening, it is possible to access the movement region S1 of the carriage unit 28 by opening the second tray 26, and it is possible to perform paper jam processing and the like, for example. Here, since the section 84*a* of the ink tubes 84 which turns in the −X-axis direction from the curved portion 88 and is connected to the carriage unit 28 is disposed in an end portion region on the downstream in the discharge direction on the reverse side of the first tray 24, the ink tubes 84 assume a state of being concealed on the reverse side of the first tray 24 when the second tray 26 is opened, it is possible to avoid unintentional access to the ink tubes 84, and it is possible to suitably maintain the ink flow paths.

Modification Example of Embodiment

In the embodiment, a configuration is adopted in which the tube support surface 86*a* is directly provided on the roller support frame 86. However, instead of this configuration, a configuration may be adopted in which the tube support surface is indirectly provided. Specifically, as illustrated in FIG. 14, a flat portion 98*a* which extends in the X-axis direction is provided on a roller support frame 98 and a sheet material 100 is attached to the flat portion 98*a*. The sheet material 100 extends from the flat portion 98*a* in the +X-axis direction and curves and extends in the +Z-axis direction to go along the curved portion 88 of the ink tubes 84. In this modification example, the sheet material 100 is positioned between the ink tubes 84 and the roller support frame 98 and functions as a tube support surface. In the same manner as with the roller support frame 86, the first driven roller 54*b* and the second driven roller 56*b* are attached to the roller support frame 98 to rotate freely.

The printer 10 is provided with the roller support frame 98 which supports the first driven roller 54*b*, and the tube support surface is formed by the sheet material 100 which is provided on the roller support frame 98. In this configuration, since a configuration is adopted in which the ink tubes 84 are indirectly supported by the roller support frame 98, it is not necessary to provide a dedicated part for supporting the ink tubes 84 and it is possible to obtain cost reductions. It is possible to suppress the wear of the ink tubes 84 using the sheet material 100. Therefore, it is preferable that the sheet material 100 be formed by a material having a lower rigidity than the roller support frame 98.

Regarding Medium Detection Unit in Curved Inversion Path

Next, FIGS. 15 to 17 describe a medium detection unit 102 in the curved inversion path 36 in the embodiment and the modification example. As illustrated in FIG. 16, the curved inversion path 36 is configured by the curved inversion path forming portion 60. The curved inversion path forming portion 60 is provided with an inside path portion 60*a* which is provided on the housing 12 side, and an outside path portion 60*b* which is provided on the −Y direction side end portion of the second cover 80.

In the curved inversion path forming portion 60, the outside path portion 60*b* in the state in which the second cover 80 is closed (the top and bottom portions of FIG. 16) forms the curved inversion path 36 by maintaining a predetermined interval while facing the inside path portion 60*a*.

Here, in the embodiment, the medium detection unit 102 which detects the passage of the medium P is provided in the curved inversion path 36. As illustrated in the top portion of FIG. 16, the medium detection unit 102 in the embodiment is provided with a lever portion 104 and a detection sensor 106, for example. In the embodiment, the detection sensor 106 is provided with a light emitting unit and a light receiving unit which are configured as an optical sensor and face each other leaving an interval therebetween. In the embodiment, the detection sensor 106 is configured to assume a detecting state in a case in which the light receiving unit receives the light from the light emitting unit.

The lever portion 104 is provided with a protrusion portion 104*a*, a rotational movement shaft 104*b*, and a detection target portion 104*c*. As illustrated in FIG. 16, the lever portion 104 is configured to be capable of rotational movement using the rotational movement shaft 104*b* as a fulcrum. In a state in which the medium P is not fed to the curved inversion path 36, the protrusion portion 104*a* protrudes from the inside path portion 60*a* to the curved inversion path 36 side, assumes a state of blocking the curved inversion path 36, and assumes a state of being in contact with a regulating portion 60*c* which is provided on the outside path portion 60*b*. The regulating portion 60*c* restricts the rotational movement of the lever portion 104 in the clockwise direction of the top portion of FIG. 16 in a state in which the regulating portion 60*c* abuts the protrusion portion 104*a*.

Accordingly, the detection target portion 104*c* of the lever portion 104 enters the space between the light emitting unit and the light receiving unit of the detection sensor 106 and blocks the light such that the light from the light emitting unit is not received by the light receiving unit. This state is the non-detecting state of the medium detection unit 102.

Meanwhile, as illustrated in the bottom portion of FIG. 16, when the medium P is fed into the curved inversion path 36, the leading end of the medium P engages with the protrusion portion 104*a* of the lever portion 104 and pushes the protrusion portion 104*a* to the downstream side in the discharge direction of the medium P. As a result, the lever portion 104 rotationally moves in a counterclockwise direction in the bottom portion of FIG. 16, using the rotational movement shaft 104*b* as a fulcrum. The bold line which is given a reference numeral P4 in FIG. 16 indicates the path of the medium P which is fed into the curved inversion path 36.

As a result, since the detection target portion 104*c* of the lever portion 104 also rotationally moves in the counterclockwise direction in the bottom portion of FIG. 16, using the rotational movement shaft 104*b* as a fulcrum, the light from the light emitting unit of the detection sensor 106 is not blocked by the detection target portion 104*c*, the light is received by the light receiving unit, and the detection sensor 106 assumes the detecting state. Specifically, the detection sensor 106 transmits a detection signal to the control unit (not illustrated) which is provided inside the printer 10.

Next, as illustrated in FIG. 17, when the cover 76 is rotationally moved to the front surface side of the housing 12, the second cover 80 also rotationally moves to the front surface side of the housing 12. As a result, the outside path portion 60*b* in the curved inversion path forming portion 60 assumes a state of being separated from the inside path portion 60*a* and the inside path portion 60*a* assumes a state of being exposed.

In this state, since the regulating portion 60*c* is displaced to the front surface side of the housing 12, the abutting state between the regulating portion 60*c* and the protrusion portion 104*a* of the lever portion 104 is relieved. As a result, the lever portion 104 rotationally moves in a clockwise direction in FIG. 17, using the rotational movement shaft 104*b* as a fulcrum. As a result, since the detection target portion 104*c* of the lever portion 104 also rotationally moves in the clockwise direction in FIG. 17, using the rotational movement shaft 104*b* as a fulcrum, the light from the light emitting unit of the detection sensor 106 is not blocked by the detection target portion 104*c*, the light is received by the light receiving unit, and the detection sensor 106 assumes the detecting state. Specifically, the detection sensor 106 transmits a detection signal to the control unit (not illustrated) which is provided inside the printer 10.

Therefore, the medium detection unit 102 in the embodiment detects not only the medium P inside the curved inversion path 36, but also detects the switching from a state in which the second cover 80 is closed to a state in which the second cover 80 is open. Accordingly, it is possible to detect the medium and to detect the opening and closing of the cover using a single detection unit, and it is possible to obtain a simplification in the apparatus configuration.

In the embodiment, it is possible to confirm that the medium P does not remain inside the curved inversion path 36 before the recording action by providing the medium detection unit 102 inside the curved inversion path 36. In a case in which it is possible to detect the medium P inside the curved inversion path 36 during the recording action or after the recording action, a control unit (not illustrated) is capable of performing error determination as a paper jam error. Additionally, the actions of each of the rollers are stopped after each of the rollers is rotated by a predetermined amount by detecting the rear end of the medium P during the recording action (the switching from the detecting state to the non-detecting state). In a case in which the rear end of the medium P is not detected, the control unit (not illustrated) performs error determination as a paper jam error.

In the embodiment, in a case in which the paper jam error occurs inside the curved inversion path 36, it is possible to switch the second cover 80 from the closed state to the open state (FIG. 17) and remove the medium P which is jammed inside the curved inversion path 36. Subsequently, when the second cover 80 is switched from the open state to the closed state (the top portion of FIG. 16), the medium detection unit 102 is capable of detecting that the second cover 80 is closed and it is possible to resume the recording job in the printer 10.

For example, in a case in which the medium detection unit 102 is in the detecting state before the recording job execution, since this is a state in which the medium P remains inside the curved inversion path 36 or in which the second cover 80 is open, the control unit (not illustrated) causes a display unit (for example, a display panel) which is provided on the operation unit 20 to display a guidance display (for example, "please remove the paper and close the cover").

In a case in which the detecting state of the medium detection unit 102 continues even if a discharge action which is greater than or equal to the length of the medium P in the transport direction of the medium P is performed on the medium P during the recording job execution, it is assumed that a paper jam error has occurred in the curved inversion path 36, and the control unit (not illustrated) temporarily stops the recording action and causes the display unit (for example, a display panel) which is provided on the operation unit 20 to display a guidance display (for example, "please remove the paper and close the cover"). Similar control is also performed in a case in which the second cover 80 is opened during the recording job execution.

In the embodiment, the roller support frames 86 and 98 and the tube support surfaces 86*a* and 100 according to the invention are applied to an ink jet printer which serves as an example of the recording apparatus. However, it is also possible to apply the roller support frames 86 and 98 and the tube support surfaces 86*a* and 100 to other liquid ejecting apparatuses in general.

Here, the liquid ejecting apparatus is not limited to a recording apparatus such as a printer, a copier, or a facsimile in which an ink jet recording head is used and an ink is discharged from the recording head to perform recording on a recording medium, and includes an apparatus which ejects, instead of the ink, a liquid corresponding to the usage thereof from a liquid ejecting head corresponding to the ink jet recording head onto an ejection target medium corresponding to the recording medium to cause the liquid to adhere to the ejection target medium.

Other than the recording head, examples of the liquid ejecting heads include color material ejecting heads used in the manufacture of color filters of liquid crystal displays and the like, electrode material (conductive paste) ejecting heads used to form electrodes of EL displays, field emission displays (FED), and the like, biological organic matter ejecting heads used in the manufacture of biochips, and sample ejecting heads which serve as precision pipettes.

The invention is not limited to the examples and may be modified in various ways within the scope of the invention described in the claims, and the modifications should be construed as being included in the invention.

The entire disclosure of Japanese Patent Application No. 2017-229211, filed Nov. 29, 2017, is expressly incorporated by reference herein.

What is claimed is:

1. A liquid ejecting apparatus comprising:

a carriage unit which is provided with a liquid ejecting head which ejects a liquid onto a medium, and which moves reciprocally in a scanning direction;

a liquid storage container which is storing the liquid to be ejected from the liquid ejecting head;

a tube which is connected to the carriage unit and which supplies the liquid which is fed from the liquid storage container to the carriage unit;

a first driven roller which is provided on a downstream of the liquid ejecting head in a transport path of the medium and which comes into contact with a surface of the medium which faces the liquid ejecting head; and a tube support surface which is provided to extend along the scanning direction of the carriage unit and supports the tube, wherein, setting one direction in the scanning directions of the carriage unit to a first direction and the other direction to a second direction, the tube extends along the tube support surface toward the second direction, forms a curved portion which curves vertically upward, turns in the first direction and is connected to the carriage unit, and wherein the tube support surface is at a position which is deviated from the first driven roller in the transport direction of the medium and a height in the vertical direction of the tube surface is the same as a height of at least a portion of the first driven roller in the vertical direction.

2. The liquid ejecting apparatus according to claim 1, further comprising:

a roller support frame which supports the first driven roller, wherein the tube support surface is formed by the roller support frame.

3. The liquid ejecting apparatus according to claim 1, further comprising:

a roller support frame which supports the first driven roller, wherein the tube support surface is formed by a sheet material which is provided on the roller support frame.

4. The liquid ejecting apparatus according to claim 1, further comprising:

a second driven roller which contacts a surface of the medium which faces the liquid ejecting head on a downstream of the first driven roller in the transport path of the medium, wherein the tube support surface is positioned between the first driven roller and the second driven roller in the transport direction of the medium.

5. The liquid ejecting apparatus according to claim 4, wherein the tube support surface falls within a height range of the second driven roller in the vertical direction.

6. The liquid ejecting apparatus according to claim 2, wherein a bottom surface of the roller support frame forms the transport path of the medium.

7. The liquid ejecting apparatus according to claim 1, further comprising:

a curved inversion path which is provided on a downstream of the first driven roller in the transport path of the medium and which causes the medium to curve so as to be inverted with a surface of the medium on which recording is recently performed facing an inside; and a discharge roller which discharges the medium which is curved and inverted by the curved inversion path.

8. The liquid ejecting apparatus according to claim 7, wherein the curved portion which is formed in the tube falls within a height range of the curved inversion path in the vertical direction.

9. The liquid ejecting apparatus according to claim 7, further comprising:

a medium receiving tray which is inclined to face upward along a discharge direction of the medium by the discharge roller and receives the medium which is discharged by the discharge roller, wherein the medium receiving tray is configured to include a first tray which is positioned on an upstream in the discharge direction and is provided in a fixed manner, and a second tray which is positioned on the downstream of the first tray in the discharge direction, is provided to be capable of opening and closing, and exposes a movement region of the carriage unit by opening the second tray, and wherein a section of the tube which turns in the first direction from the curved portion and is connected to the carriage unit is disposed in an end portion region on a downstream in the discharge direction on a reverse side of the first tray.

10. A liquid ejecting apparatus comprising:

a carriage unit which is provided with a liquid ejecting head which ejects a liquid onto a medium, and which moves reciprocally in a scanning direction;

a liquid storage container which is capable of storing the liquid to be ejected from the liquid ejecting head;

a tube which is connected to the carriage unit and which supplies the liquid which is fed from the liquid storage container to the carriage unit;

a tube support surface which is provided to extend along the scanning direction of the carriage unit and supports the tube;

a curved inversion path which is provided closer to a downstream than the liquid ejecting head in the transport path of the medium and which causes the medium to curve so as to be inverted with a surface of the medium on which recording is recently performed facing an inside;

a discharge roller which discharges the medium which is curved and inverted by the curved inversion path; and a medium receiving tray which is inclined to face upward along a discharge direction of the medium by the discharge roller and receives the medium which is discharged by the discharge roller, wherein, setting one direction in the scanning directions of the carriage unit to a first direction and the other direction to a second direction, the tube extends along the tube support surface toward the second direction, forms a curved portion which curves vertically upward, turns in the first direction and is connected to the carriage unit, wherein the medium receiving tray is configured to include a first tray which is positioned closer to an upstream in the discharge direction and is provided in a fixed manner, wherein a section of the tube which turns in the first direction from the curved portion and is connected to the carriage unit is disposed in an end portion region on a downstream in the discharge direction on a reverse side of the first tray, and wherein a height of the tube support surface in the vertical direction is the same as a height of at least a portion of the discharge roller in the vertical direction.

11. The liquid ejecting apparatus according to claim 10, wherein the medium receiving tray is configured to include a second tray which is positioned on the downstream of the first tray in the discharge direction, is provided to be opening and closing, and exposes a movement region of the carriage unit by opening the second tray.

* * * * *